US007557284B2

(12) United States Patent
Mori et al.

(10) Patent No.: US 7,557,284 B2
(45) Date of Patent: Jul. 7, 2009

(54) APPARATUS FOR SUPPORTING A MUSICAL INSTRUMENT

(75) Inventors: Yoshiaki Mori, Hamamatsu (JP); Kiyoshi Yoshino, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 12/016,162

(22) Filed: Jan. 17, 2008

(65) Prior Publication Data

US 2008/0179266 A1 Jul. 31, 2008

(30) Foreign Application Priority Data

Jan. 31, 2007 (JP) ..... 2007-022028

(51) Int. Cl.
*G10D 13/02* (2006.01)

(52) U.S. Cl. ..... 84/421

(58) Field of Classification Search ..... 84/421, 84/327, 329; 248/443; 206/314
See application file for complete search history.

(56) References Cited

U.S. PATENT DOCUMENTS 4,381,690 A * 5/1983 Kimble ..... 84/422.3

FOREIGN PATENT DOCUMENTS

JP S58-180594 5/1982
JP 2006-259193 9/2006

* cited by examiner

*Primary Examiner*—Kimberly R Lockett
(74) *Attorney, Agent, or Firm*—Foley & Lardner LLP

(57) ABSTRACT

An apparatus for supporting musical instruments including at least one center pipe, at least one base to support the center pipe, at least one tubular arm pipe, wherein one end of the arm pipe is coupled to the center pipe, at least one clamp structure that can be coupled to the other end of arm pipe, capable of locking into the arm pipe while grasping at least one rod. The rod can support at least one musical instrument. The rod can be surrounded by a flexible bushing and clamps to hold the rod in place.

21 Claims, 10 Drawing Sheets

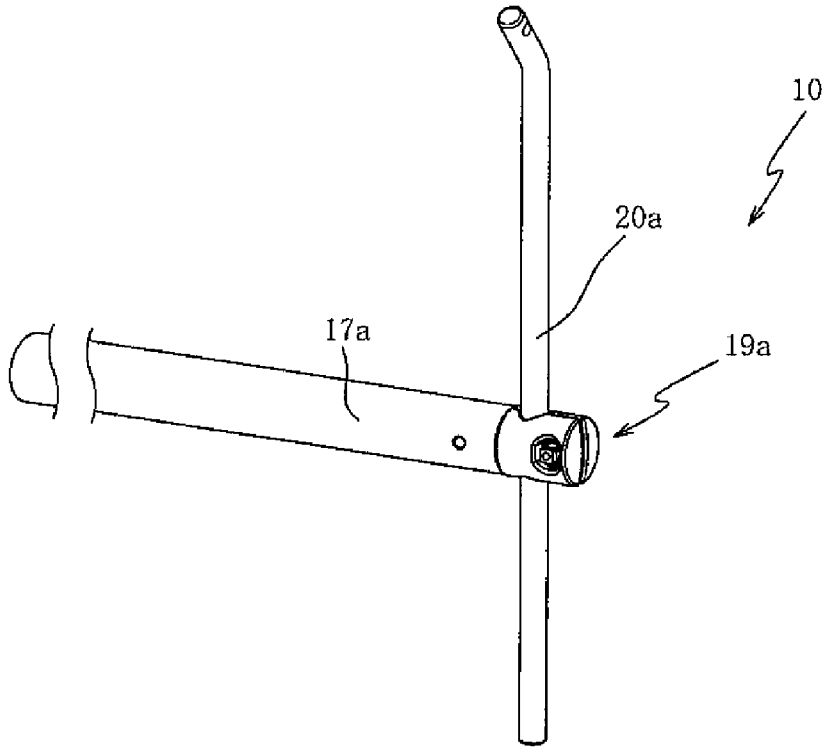
Figure 2 ( a )
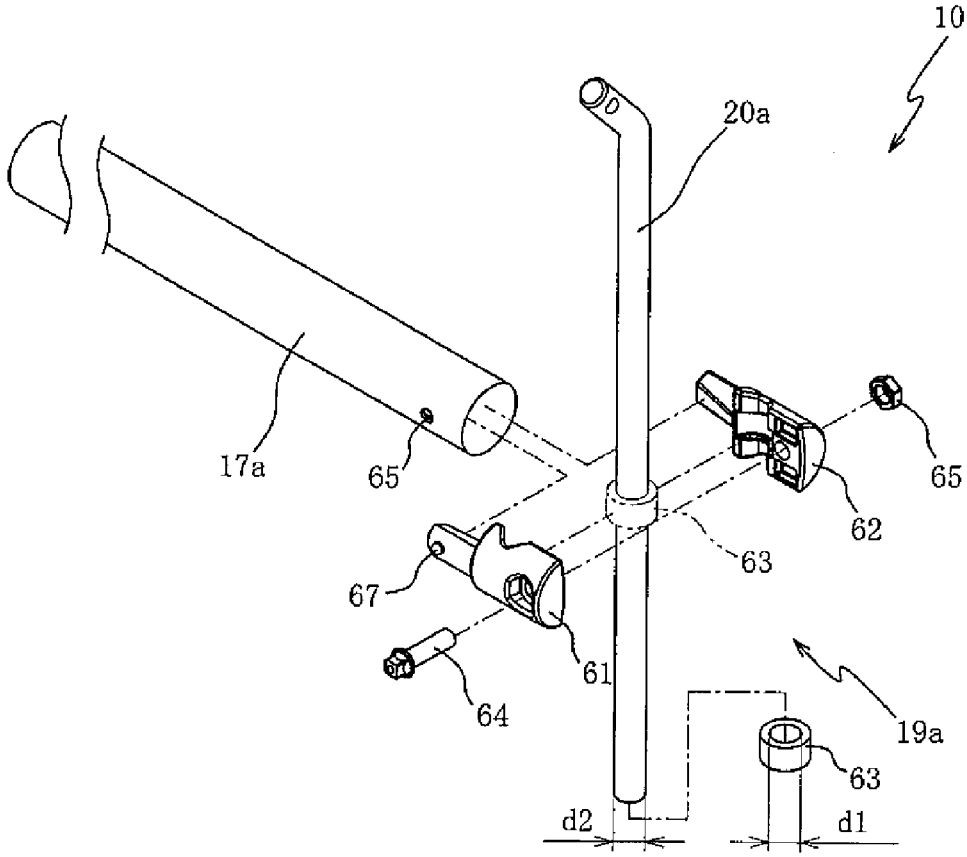
Figure 2 ( b )

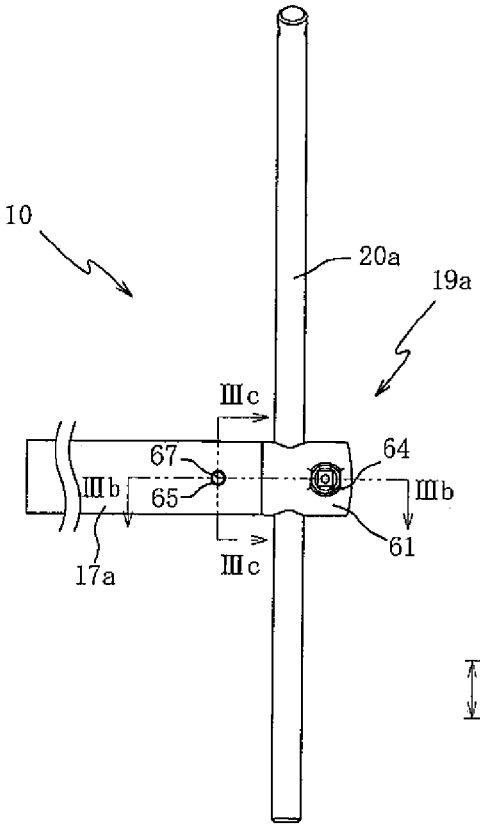
Figure 3 ( a )
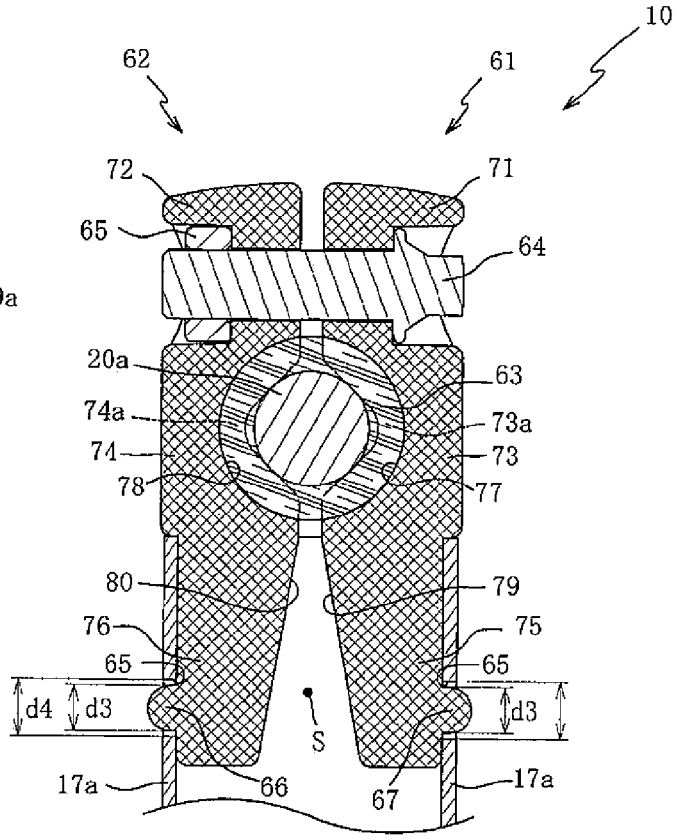
Figure 3 ( b )
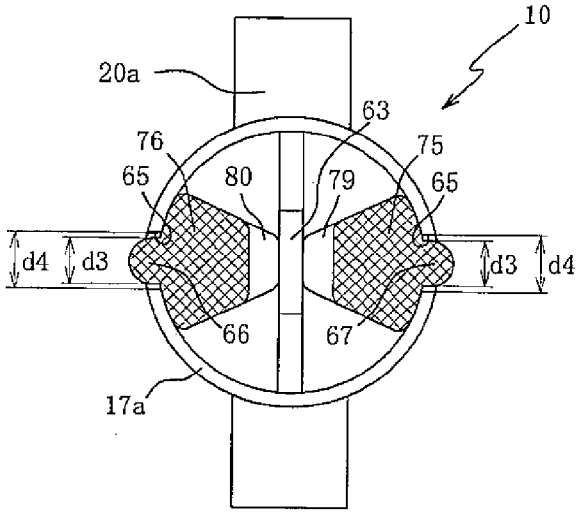
Figure 3 ( c )

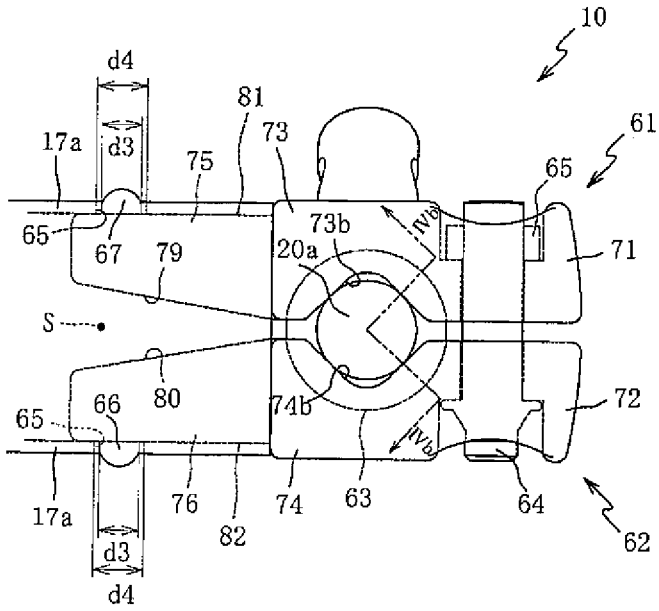
Figure 4 ( a )
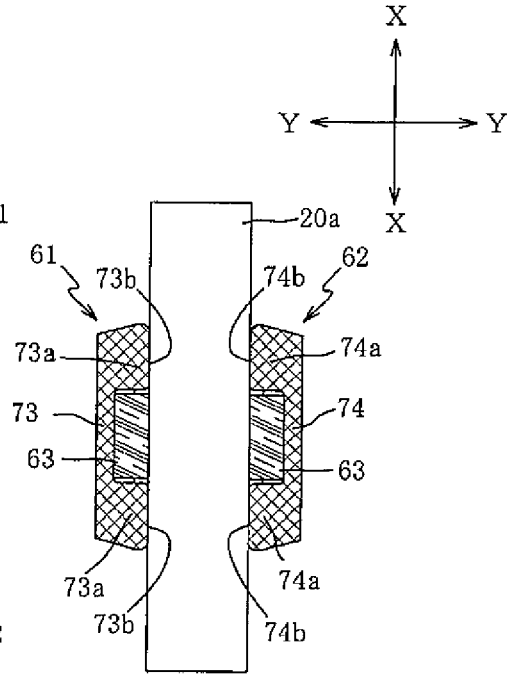
Figure 4 ( b )
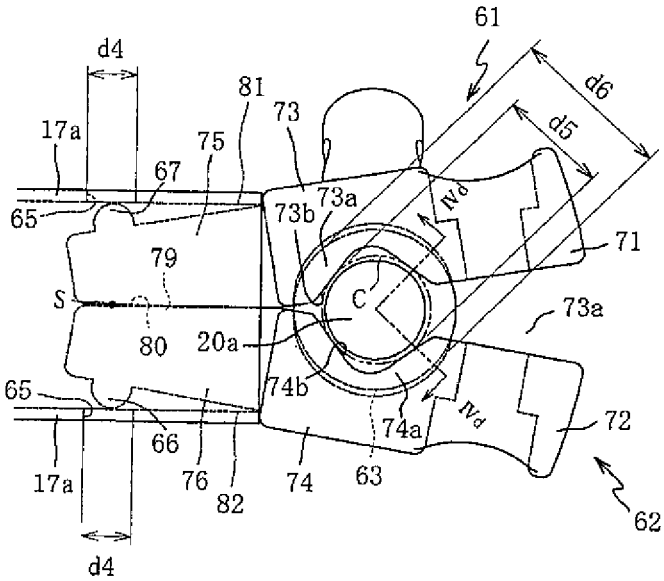
Figure 4 ( c )
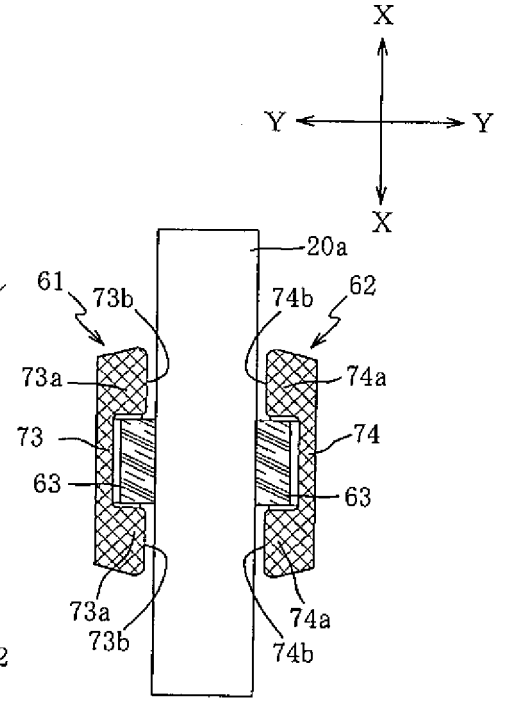
Figure 4 ( d )

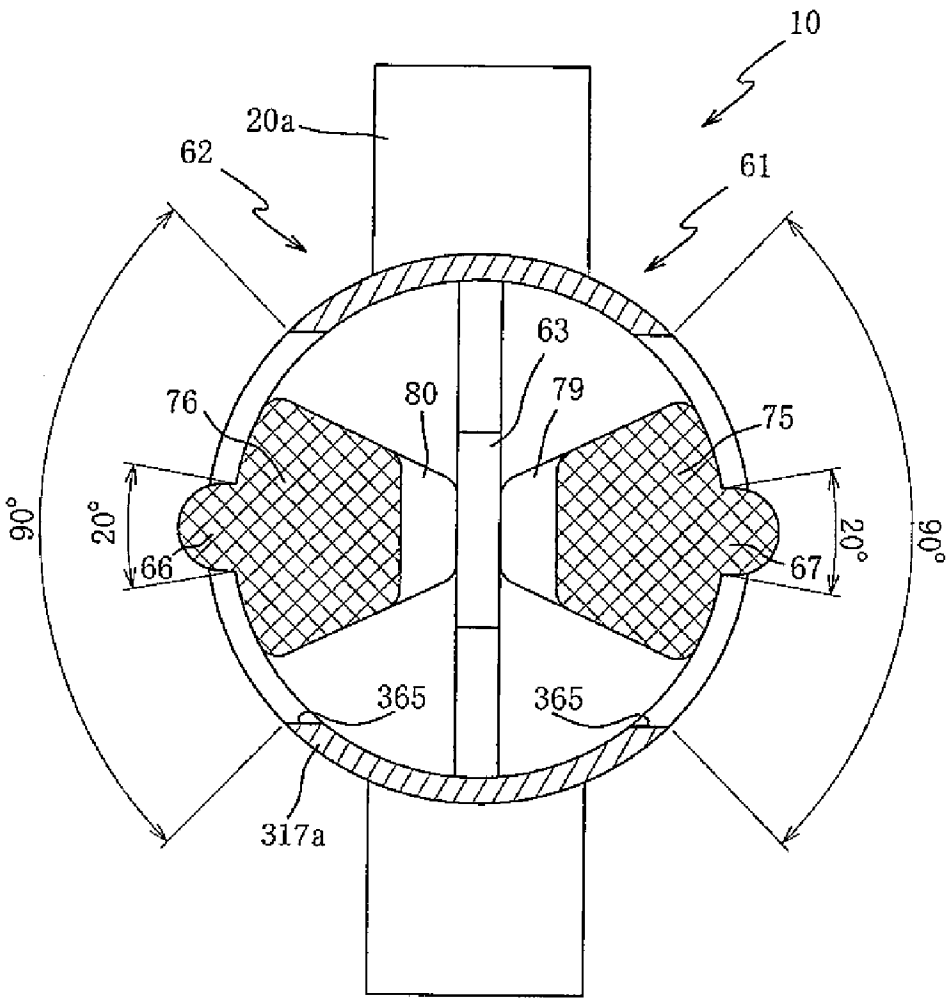
Figure 5( b )
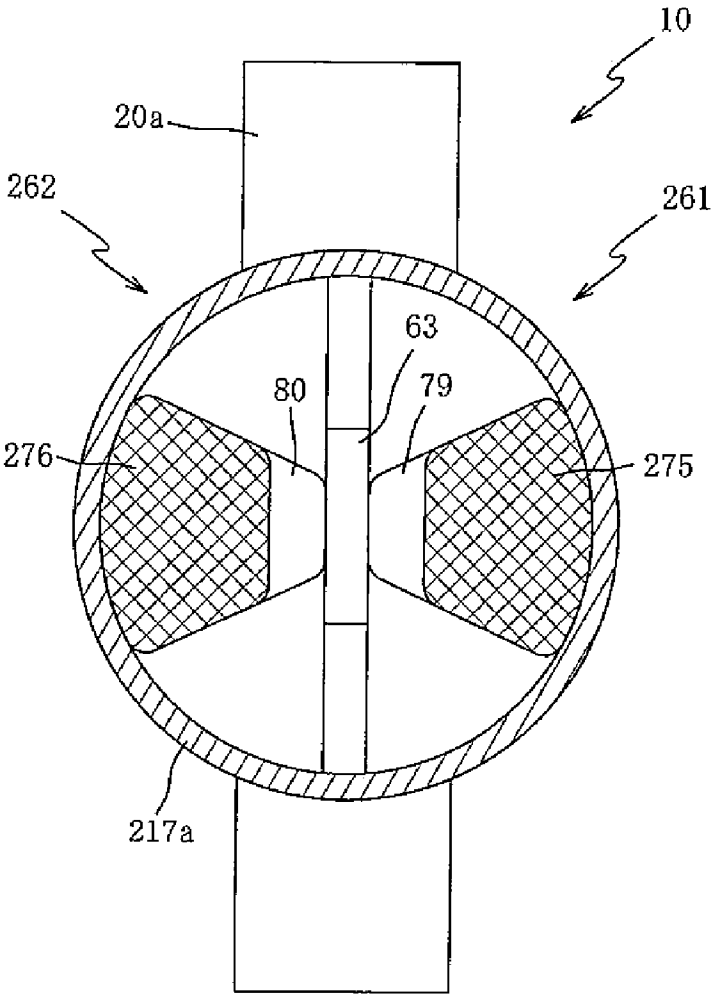
Figure 5( a )

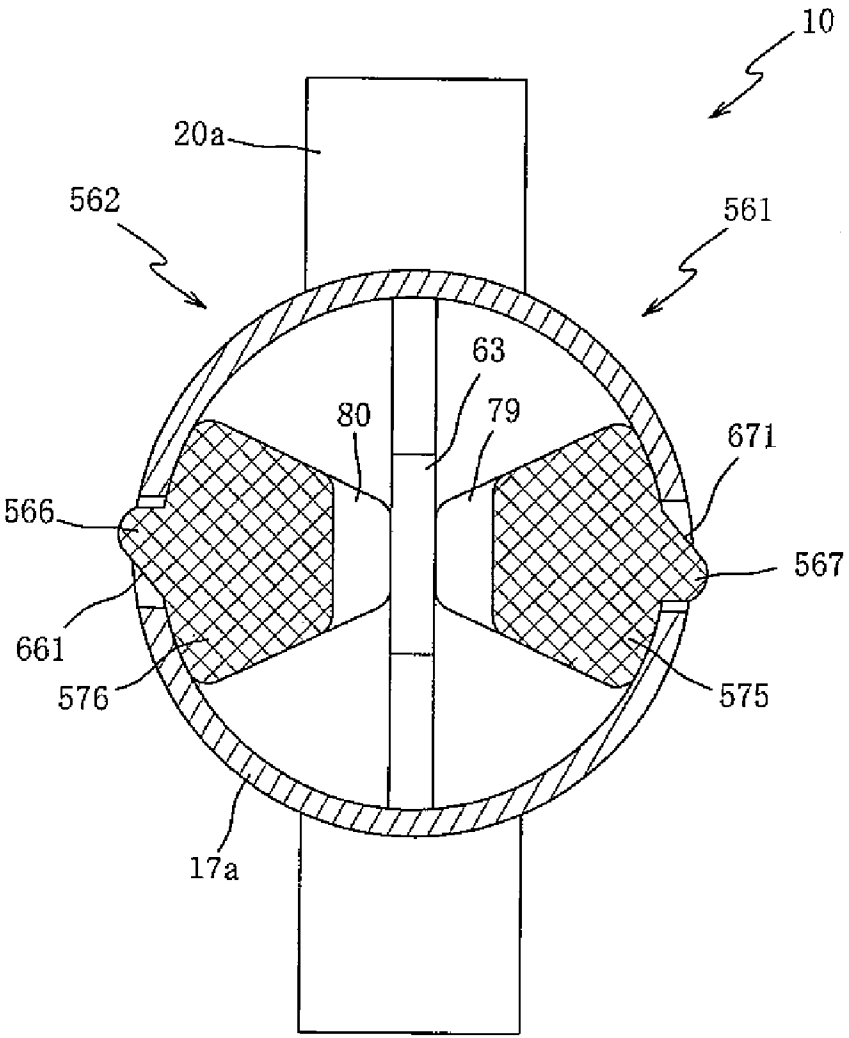
Figure 6 ( b )
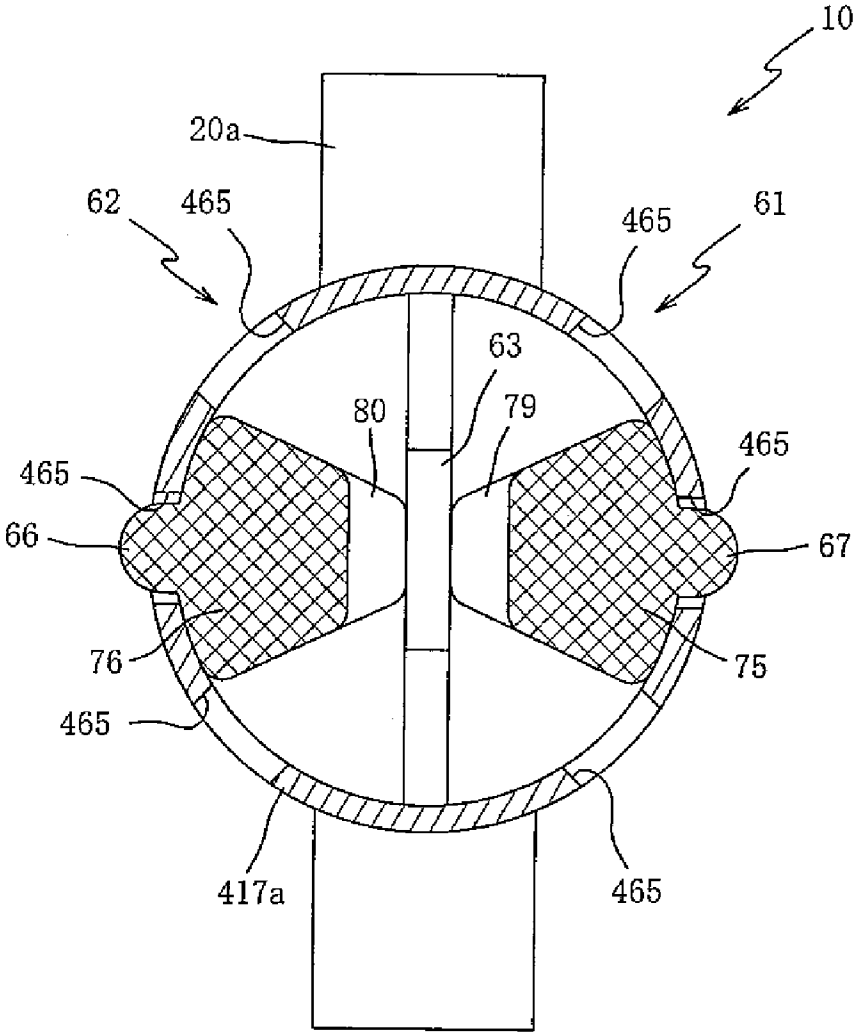
Figure 6 ( a )

APPARATUS FOR SUPPORTING A MUSICAL INSTRUMENT

CROSS-REFERENCE TO RELATED PATENT APPLICATIONS

Priority is claimed from Japan Priority Application 2007-022028, filed Jan. 31, 2007 including the specification, drawings, claims and abstract, is incorporated herein by reference in its entirety.

BACKGROUND OF THE DISCLOSURE

1. Field of the Invention

Embodiments of the current invention relate generally to the field of percussion instrument stands. Particular embodiments relate to a pipe system held together and secured with clamping units, utilized for supporting electronic percussion instruments. Embodiments of the current invention can be useful for attaching the pipes to each other to form various structural configurations and be placed in various positions.

2. Background

Various percussion instrument stands are used by artists to hold instruments. Embodiments of the current invention are designed for optimal utilization by a person playing electronic percussion instruments. Embodiments of the current invention can allow the artist to set the desired position, pitch, angle, height, and spacing of various instruments. Embodiments of the current invention provide sufficient flexibility in positioning various instruments to accommodate particular tastes of different artists. The pipe structure described below provides flexibility to meet the demands of artists, strength to secure the instruments and withstand the forces of impacts during intense playing.

FIG. 10 is a sectional drawing of the clamp member 100 currently being used for electronic musical instruments. The clamp member 100 comprises a clamp body 102 with a first support section 100*a* and a second support section 100*b*. The first pipe 101*a* and second pipe 101*b* can be inserted into the first and second support section. The first lock member 103*a* and second lock member 103*b* oppose the clamp body 102. A plurality of bolt member 104*a*-105*b* can be used to engage with lock member 103*a* and 103*b* and clamp body 102.

The clamp member 100 can rotate the first and second pipes 101*a* and 101*b* in a outer direction of and also secure the location of the first and second pipes. As a result the performer can change the combination position of both pipes and can adjust the position (height, angle, or distance with a performer) in which an electronic musical instrument is installed.

The bolt member for this clamp member 100 secures the two pipes individually. As a result the combination activity needed to secure using the bolt member on both the pipes individually, and was complicated.

SUMMARY OF THE DISCLOSURE

Embodiments of the current invention relate to a piping structure that includes an arm pipe and a rod. The piping system also includes a coupling system involved in connecting the arm pipe and the rod to an electronic percussion instrument stand. The arm pipe utilizes its hollow tubular structure to attach the rod by using the coupling system. The coupling system, can include a first and a second clamp, that can be the bolted together. The first and second clamp can be attached on the inside of the arm pipe. The bolt holds among other components the coupling system formed in part by the first and second clamp. The second locking structure and the second clamp are attached to the second constriction structure which is also connected to the first clamp. The first and second clamp are connected via the bolting structure, while the rod is being held in place by the first and second constriction structure it is also being held by the first and second locking structure. The inside area of the arm pipe is also subject to pressure for structural support.

According to one embodiment of the electronic percussion instrument stand the first and second locking structures are subjecting the interior of the arm pipe to outer pressure from the internal protrusion. The arm pipe, with at least one hole through both the internal and external layers, said hole possessing a larger circumference on the interior than that of the exterior receives the protrusion into this hole to secure the coupling system.

In another embodiment of the electronic percussion instrument stand there is at least one hole in the arm pipe. The hole receives the protrusion into the differentiated diameters of the hole and with the inclusion of the locking structure, the hole and protrusion interaction allows the coupling system to be moved and adjusted. The position relative to the remainder of this structure of the circular end of the arm is dependant upon the positioning of the first and second clamps.

In another embodiment of the current invention a pipe guide is placed on the interior of the arm pipe and can travel the entire length of the arm pipe. The pipe guide can be a railing or a ridge. The pipe guide can be limited to the region surrounding the arm pipe ends.

The first and the second locking structures, utilize the pipe guide within the arm pipe to guide and secure the pipe as it moves and extends. The hole should be aligned with the protrusions for efficient functionality and for the pipe guides and the locking structures to maintain alignment.

According to another embodiment of the current invention, the positioning of the rod, the first and second constriction structures and the connection structure utilizes a flexible material cushion to properly attach the rod to the first and second constriction structures. By using the flexible material cushion between the two structures in order to provide not only stability but strength when struck. This also reduces the friction arising from the connection of rod and other structures, the friction due to vibration being dampened by the flexible material cushion. While the friction between the rod and the first and second constriction structures is dampened, the flexible material cushion can also be used to maintain proper alignment of all of the components described above. The dampening aids in maintaining proper alignment without the loss of stability or damage to the stand which could occur without the support of the flexible material cushion.

The flexible material cushion is placed on the exterior circumference of the rod. The internal diameter of the flexible material cushion can be smaller than the external diameter of the rod allowing flexible material cushion to attach to the flexible material cushion. The first constriction structure can interact with the flexible material cushion and use the internal guide ridges of the first side wall structure to guide the insertion of the second constriction structure. The first and second side wall guide ridges allow the rod to fully utilize the elastic properties of the flexible cushion material and its connection with the rest of the stand structure for optimal usage with minimal wear and tear on the components. The flexible material cushioning also acts as a stopping mechanism for the first and second constriction structures when the rod is inserted into the side wall ridge guides.

Another embodiment of the electronic percussion stand includes the adjusting the height of each component. The height of each component can be controlled along the side wall guide tracks. The flexible material cushion can act along the entire length of the rod from inside and outside, which allows for both major and minor adjustments to be made with ease. Next, the first and second connecting components are secured by the bolt and secured by the constriction effects of the first and second constriction structures along the rod. The first and second side wall guide ridges also act to secure the components within the coupling structure.

In another embodiment of the current invention, the first and second clamp, the first and second side wall structure are secured by the surface tension created by the flexible material cushion on the side wall structures, the first and second clamps. Given the nature and the surface area of the flexible material cushion within the first and second side wall structure, the coupling system can be secured by utilizing the bolting mechanism. The first and second constricting structures can then be effectively applied and the coupling system can be filled and secured.

According to one embodiment of the current invention the hollow portion of the arm pipe can be coupled to the constricted section of the rod, the first clamp and the second clamp. The first and second clamp can be connected by a bolt structure or other similar structures such as but not limited to, a clamp, fastener or rivet. The first clamp can be coupled to the first pipe via the first locking structure, the bolt structure and the first connective structure. The first connective structure and the first locking structure are assembled into a connection member along with the first constrictive structure and the second clamp assembly. The connection member is attached to the internal portion of the first arm pipe via the first and second locking structure, the bolt and the second connective structure. The first constrictive structure, the first connective structure and the second connective structure are coupled by the bolt to the rod which can be connected via the first constriction structure to the overall connection member. The rod is also connected via constriction to the connection member by the first and second constriction structure. While the rod is connected to the overall unit via the aforementioned constriction structure it is also under pressure within the arm pipe provided by the first locking structure as well as the second locking structure. At the same time in this positioning the first clamp and the second clamp are connected via the bolt which allows the arm pipe and the rod to remain connected.

According to another embodiment, the first locking structure as well as the second locking structure can be under pressure applied by the internal structures of the arm pipe. From the exterior of the arm pipe to the interior of the arm pipe there is at the least a single hole with the inner diameter of this hole being larger than the outer diameter of the protrusion. The protrusion utilizes this hole to the lock into the structure to secure the clamps. This allows the arm pipe to connect with the first clamp as well as the second clamp to secure the unit and maintain cohesion. The ability to adjust the positioning of the first clamp as well as the second clamp along the axis of this hole in the arm pipe allows for the overall unit structure to be moved into a number of different positions allowing for a great deal of flexibility for the stand in its various formations.

According to the embodiments of the electronic percussion instrument stand the hole can be circular in diameter and shaped to fit the protrusions. When a protrusion is inserted into the hole the connection created allows the first clamp and the second clamp to move. The movement of the clamp also allows variable positions for the components and structures attached to each structure respectively. However, when the protrusion of the clamp is inserted into the hole, the arm pipe can be moved. Once the second clamp is inserted in to the arm pipe and its protrusion is inserted into a hole in the arm pipe the clamps can be difficult remove from the interior of the arm pipe. When the clamps are in the arm pipe they may not be allowed to vary their position within the arm pipe itself while retaining the ability to move freely outside of the pipe.

Thus while the first clamp and the second clamp are attached to the arm pipe in the protrusion and hole set up of the arm pipe it is not necessary to attach them using a nut because the overall structure does not allow for a significant amount of movement. The first clamp and second clamp will not slip out of the arm pipe while inside the arm pipe. The result of this feature is that the first clamp and the second clamp that are attached to the second arm pipe can be freely adjusted while maintaining the position relative to the first arm pipe without affecting overall stability.

Another embodiment of the current invention includes an internal pipe guides in within the arm pipe that travels from one end of the arm pipe to the other end. The protrusions, the first locking structure and the second locking structure use the guides when being inserted into the arm pipe. Thus by following the pipe guide the protrusion and locking structures travel smoothly along the pipe guide into the protrusion holes allowing the protrusions to be secured of from the arm pipe via the first and second clamps. The pipe guides allow the clamps to run smoothly into the correct position without having to worry about the inserted piece twisting into the incorrect position and becoming stuck within the arm pipe.

Thus, when inserted the clamps are be guided along the pipe guide into the correct position for the protrusion to lock outwards through the hole and be secured in the correct position for the structure without having to guide the unit into proper alignment by sight or touch. Specifically the addition of the pipe guide, allows the user to insert the clamps with attachments efficiently without the any room for error. One benefit of this feature is that it allows, proper alignment of the first and second clamps into the arm pipe, it also allows easier positioning and repositioning of the rod in relation to the first arm pipe.

Another benefit of the above system is that when the connective structures are attached, such as the first constriction structure and the second constrictive structure, then the rod as connected to the arm pipe with the flexible material cushion can be easily adjusted into a new position without the loss of stability or whole unit. The flexible material cushion between the rod and the first and second constriction structures allows the constriction structures to grip the rod. This also allows the first and second clamp to utilize the friction stoppage caused by the flexible material cushion to adjust the position of the rod. This feature works efficiently to secure the musical instrument even in the event that the bolt securing the second pipe is not connected. The friction stoppage created by the flexible material cushion on the rod makes it possible for the nut and the bolt to be simultaneously removed and yet all attached components will not automatically collapse and fall off.

According to another embodiment of current invention the flexible material cushion does not need to extend the entire length of the rod, it can extend for a short portion on the exterior length of the rod. The second constrictive structure extends at least the single edge of the flexible material cushion. When the rod is inserted the first side wall structure acts as a guide for the second constriction structure and an edge of the flexible material cushion acts to fill the gap between the rod and the constriction structure. The first side wall structure, the second side wall structure and the flexible material cushion of the rod act as an braking mechanism to simultaneously the assemblage more securely. They also give the assemblage a certain elasticity to adapt effectively to the inherent vibrations caused by percussions. The flexible material cushion also acts as a stop for the first and second side wall structures. This allows the rod to stop at the appropriate position along the first side wall structure and the second side wall structure.

Thus even if the first clamp as well as the second clamp were to be released simultaneously the rod would not move on its own volition but be held in place by the flexible material cushion acting in concert with the first and second side wall structures. The over all result is that even with the release of the first and second clamps the rod would be secure and solid without the possibility of slippage.

While the flexible material cushion may act as a brake against unnecessary slippage of the rod along with the first and second side wall structures during the release of the first clamp and the second clamp the connective structure can be removed with the proper application of force. The flexible material cushion will not prevent the unit from be disassembled in a proper manner. In order to remove the unit from this position it is necessary for one to release both the first and second clamps at the same time and then pull on the second pipe to remove it from the set position as secured by the first and second clamps, this movement will be slowed but not halted by the interior flexible material cushion. The result is the ability to easily adjust the positioning of the second pipe with the simple application of pressure to the first and second clamps and a pull upon the unit. The protrusions will thus shift out of the hole structure and can be repositioned differently along the interior track this prevents the accidental release and slippage of the first and second clamps along the line of the first pipe, According to another embodiment of the current invention the height and angle along the first side wall structure and the second side wall structure can be regulated by the flexible material cushion from both the inside and the outside of the structure. Additionally with the first connective structure and the second connective structure the connecting bolt can be adjusted allowing an adjustment of the first and second constrictive structures that holds the rod in place within the overall structure of the stand. The first side wall structure as well as the second side wall structure can be constricted through the exterior of the rod thus allowing for even greater level of stability and strength along the armature structure.

The overall strain and pressure applied on the rod can be lessened by using the flexible material cushion. The first clamp as well as the second clamp provide for even greater strength and stability than with only the first and second side wall structures alone. When all of the connective and strengthening features of the stand are applied to the rod, its ability to hold vast loads in elevated positions, remain strong and stable is greatly increased.

Due to the stabilization and the strengthening features, it is possible to lower the strength required for the rod, and thus, low cost materials can be used for the rod. Therefore, even at full elevation and extension the rod will be able to, as illustrated, maintain strength and cohesion.

According to another embodiment of the current invention the first clamp and the second clamp access the connection structure, this connection structure accepts the first clamp and the second clamp units, flexible material cushion surface these components all join smoothly together. The receiver structure also secures the first connective unit as well as the second connective unit along with the bolt structure. The first constrictive structure and the second constrictive structure connects with the flexible material cushion and locks into place with the receiver structure. The flexible material cushion acts in conjunction with the first side wall structure and the second side wall structure to securely link the rod into the overall stand structure.

A bushing has elastic properties. The elastic properties generate elastic force by a change in shape. Thus space is required for to accommodate the change in shape of the bushing. The size of the bushing can be almost the same size as the size of the space section formed by the first wall portion and the second wall portion. The elastic force exerted by the bushing can hold the second pipe using the first wall portion and the second wall portion. Also a rubber material would not allow the same degree of strength combined with flexibility which is required to secure this unit. The conjunction of all components along with the strength can be achieved with providing some space, allowing the flexible material cushion to deform into that space when pressure is applied. Thus the first and second side wall structure first operate most effectively when used with the flexible material cushion described above to secure the rod to the arm pipe.

BRIEF DESCRIPTION OF THE DRAWINGS

FIG. 2(*a*) is an perspective view illustration of an arm pipe from electronic percussion instrument stand shown in FIG. 1.

FIG. 2(*b*) is an exploded view of the arm pipe shown in FIG. 2 (*a*).

FIG. 3(*a*) illustrates the arm pipe and a rod connection shown in FIG. 1.

FIG. 3(*b*) shows a section view from a line IIIb-IIIb of FIG. 3(*a*).

FIG. 3(*c*) shows a section view from a line IIIc-IIIc of FIG. 3(*a*).

FIG. 4(*a*) is an illustration of a first clamp and a second clamp and their interaction with the arm pipe shown in FIG. 1.

FIG. 4(*b*) is a section view of the line IVb-IVb from FIG. 4 (*a*) of the first clamp and the second clamp FIG. 4(*c*) an illustration of the first clamp and the second clamp FIG. 4(*d*) is a sectional view of the line IVd-IVd from FIG. 4 (*c*) of the first clamp and the second clamp.

FIG. 5(*a*) is an illustration of another embodiment of the invention with respect to the structure shown in FIGS. 3(*a*)-3(*b*), as a sectional view from line IIIc-IIIc of the electronic percussion instrument stand 10.

FIG. 5(*b*) is an illustration of another embodiment of the invention with respect to the structure shown in FIG. 3(*a*), as a section view from line IIIc-IIIc of the electronic percussion instrument stand 10.

FIG. 6(*a*) is an illustration of the fourth embodiment of the invention with respect to the structure shown in Figure number 3(*a*), as a section view from line IIIc-IIIc of the electronic percussion instrument stand 10.

FIG. 6(*b*) illustration of the fifth embodiment of the invention as shown in Figure number 3(*a*), as a section view from line IIIc-IIIc line of the electronic percussion instrument stand 10

FIG. 9(*b*) a section view of the IXb-IXb line of the arm pipe and the first locking structure and the second locking structure of FIG. 9(*a*).

DETAILED DESCRIPTION OF PREFERRED EMBODIMENTS

Figure 1:
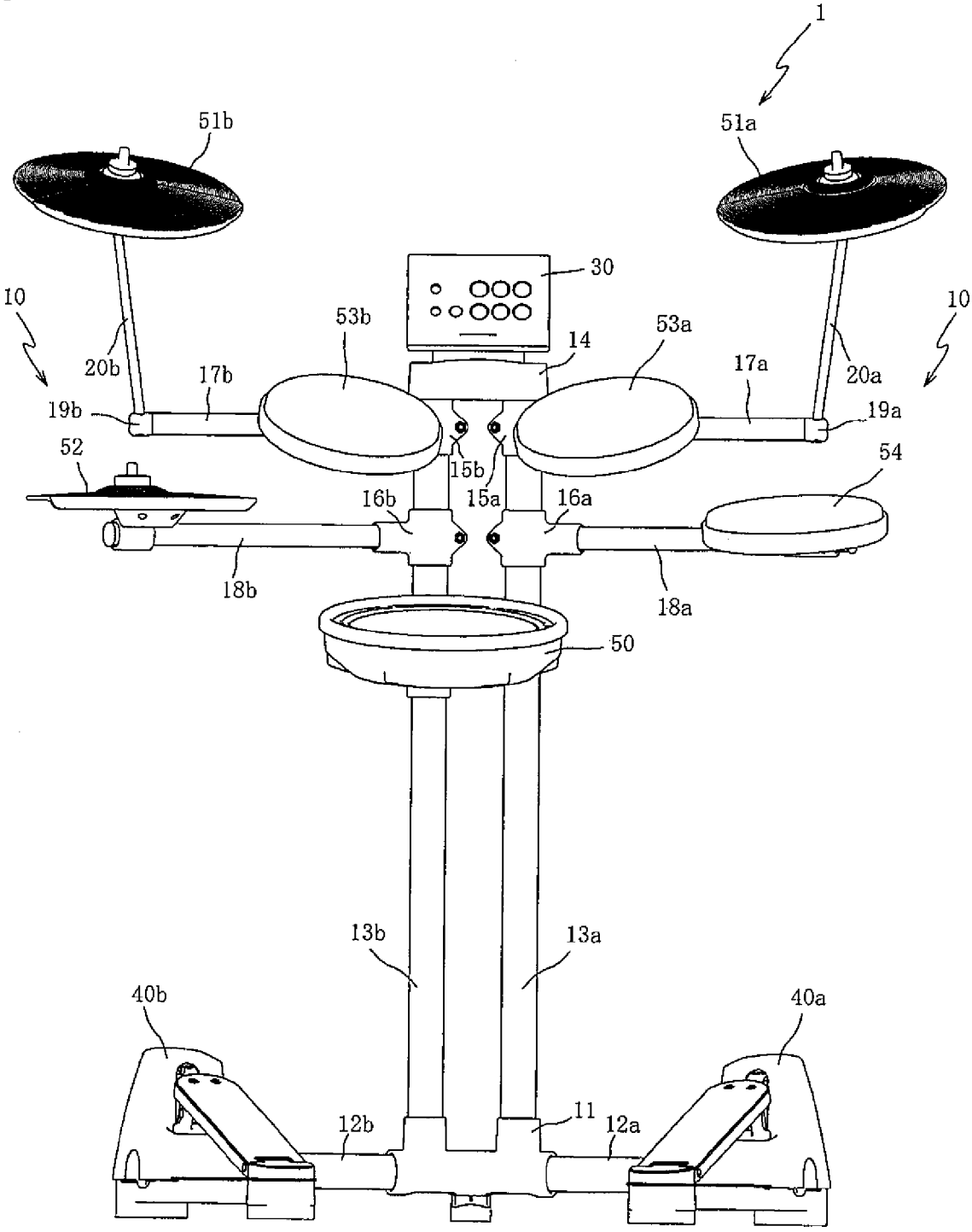
FIG. 1 illustrates one embodiment of an electronic percussion instrument stand according to a first configuration.

FIG. 1 shows one embodiment of an electronic percussion instrument stand 10 and the electronic percussion instrument stand system 1. FIG. 1 illustrates one example layout of an electronic percussion instrument stand system 1.

FIG. 1 illustrates the electronic percussion instrument stand 10 with a base 11. Base 11 (FIG. 1 right side) is coupled to pipe 12*a* and pipe 12*a* is coupled to foot pedal 40*a*. In addition, foot pedal 40*b* (FIG. 1 left side) is coupled to pipe 12*b* and pipe 12*b* is coupled to base 11. FIG. 1 also shows base 11 connected with center pipe 13*a* and center pipe 13*b*. The center pipe 13*a* can be coupled to the instrument control module 30 holder 14. The instrument control module 30 structure 30 can be coupled to the instrument control module 30 holder 14. The arm holder 15*a* can create a substantially perpendicular angle of connection between the center pipe 13*a* and the first arm pipe 17*a*. Also shown in FIG. 1 is the connection of the arm pipe 18*a* to the arm holder 16*a* as well as the entire arm assembly connection to the center pipe 13*a*. The center pipe 13*a* can be connected to the arm pipe 18*a* and the arm pipe 17*a* at varying heights, positions and angles. The center pipe 13*b* can connect similarly to the arm pipe 17*b*, and arm pipe 18*b*. The height and angle of the connection between center pipe 13*b* and 17*b* can be adjusted by arm holder 16*b*.

In an example embodiment of the current invention, the arm pipe 17*a* can be connected to, for example, a drum pad 53*a*, connection structure 19*a* (described in greater detail below) and/or rod 20*a*. Rod 20*a* can support, for example, a cymbal pad 51*a* or one or more other instruments. Also attached to the arm pipe 18*a* can be, for example, a drum pad 54 or one or more other musical instruments.

In addition, pad 53*b* and rod 20*b* can be connected to a connection point along arm pipe 17*b*. Rod pipe 20*b* can support for example, a cymbal pad 51*b* or one or more other instruments. Also, connected to the arm pipe 18*b* can be, for example, a high hat cymbal 52 or one or more other instruments. Also, a snare pad 50 can be connected to the center pipe 13*b*.

In various embodiments of the current invention, any suitable combination including one or more arm pipes 17*a*, arm pipes 17*b*, connection structures 19*a*, connection structures 19*b*, rods 20*a* and rods 20*b* can be connected to the electronic percussion instrument stand 10. Various other components besides the above mentioned components can be connected to the left or right of the electronic percussion instrument stand system 1.

FIGS. 2(*a*) and 2(*b*) illustrates further features of an embodiment of the electronic percussion instrument stand system 10. In the electronic percussion instrument stand system 1 and the electronic percussion instrument stand 10, the placement and arrangement of various components which are attached to the system on the left and right hand sides can be (but need not be) identical. FIG. 2(*a*) shows a portion of the electronic percussion instrument stand 10 in an exterior, perspective view. FIG. 2(*b*) shows a portion of the electronic percussion stand 10 in an exploded view.

As shown in FIGS. 1 and 2(*a*) the electronic percussion instrument stand 10 can include arm pipe 17*a*. The arm pipe 17*a* can be connected to rod 20*a* using the connection structure 19*a*.

The rod 20*a* can be constructed of a rigid material such as but not limited to, aluminum, metal or metal alloy. The rod 20*a* can be for example, circular or tubular. Rod 20*a* can be connected to a cymbal pad 51*a*, (as shown in FIG. 1) this connection can be adjustable and can be connected in a variety of different ways. The connection structure 19*a* can be made out of aluminum or other metal and can couple rod 20*a* to the arm pipe 17*a* at various angles and locations along the pipe 17*a*.

FIG. 2(*b*) shows rod 20*a* inserted through a bushing 63 made of a flexible material. The bushing 63 is constricted by the connection structure 19*a* in order to secure rod 20*a*. The connection structure 19*a* includes a first clamp 61 and a second clamp 62.

The arm pipe 17*a* can be formed, for example, in a circular or tubular shaped pipe constructed out of pressed and molded aluminum or other metals. In FIGS. 3(*a*)-3(*c*), various features of the arm pipe 17*a* are shown, such as the connection with the first clamp 61, the second clamp 62. FIGS. 3(*a*)-3(*c*) show the locking structure 75 and the locking structure 76 which are part of the first and second clamps 61 and 62.

First clamp 61 and second clamp 62 are constructed with a partial locking structure 75 and the partial locking structure 76. Locking structures 75 and 76 each can have a long groove (or ridge) that can allow these structures to connect with the interior of the arm pipe 17*a*. Running the length of the interior of the arm pipe 17*a* is a corresponding ridge or groove. The groves and/or ridges of arm pipe 17*a* and the grooves and/or ridges of the locking structure 75 and the partial locking structure 76 engage to connect the various parts to each other.

FIG. 3(*b*) shows the first clamp 61 and the second clamp 62 being used to constrict the bushing 63 and confine the rod 20*a* in order to provide a connection with arm pipe 17*a*. FIG. 3(*b*) illustrates the interaction of the first clamp 61, the second clamp 62, the first connection structure 71, and the second connection structure 72. FIG. 3(*b*) shows a bolt 64 and a nut 65 that connects the first and second connective structures 71 and 72 together. One method of connecting arm pipe 17*a* and rod 20*a* is, by tightening the bolt 62 to the nut 65. Other methods of assembling the above structures with or without the use of a nut or a bolt can be used as well, such as but not limited to, cables, clamps, latches, locks or rivets.

As shown in FIG. 2(*b*) the bushing 63 is formed of a rubber-like elastic material, which has an interior diameter d1 and the rod 20*a* has a larger diameter d2. When the rod 20*a* is inserted into the center of the bushing 63 the interior of the bushing 63 can elastically expand. The expansion can occur because d1 is greater than d2 and the rod 20*a* applies pressure to the bushing 63. The expansion caused by the rod 20*a* is allowed by the elastic properties of the material from which the bushing 63 is made.

FIG. 3(*a*) shows details regarding the electronic percussion stand 10. FIG. 3 (*b*) shows us an illustration of the line section 3(*a*) IIIb-IIIb of the electronic percussion instrument stand 10. FIG. 3(*c*) shows us an illustration of the line section 3(*a*) IIIc-IIIc of the electronic percussion instrument stand 10.

FIG. 3(*c*) primarily illustrates first clamp 61, second clamp 62 and related parts. The first clamp 61 is shown as it interacts with at least the following components: the first connection structure 71, the first constriction structure 73 and the first locking structure 75. Also shown in FIG. 3(*c*) is the interaction of the second clamp 62 with at least the following components: the second connection structure 72, the second constriction structure 74 and the second locking structure 76. The first clamp 61 and the second clamp 62 can be constructed of the same materials with the same properties and the same shape.

FIG. 3(*b*) depicts, among other features, the first connection structure 71 and its interaction with the first clamp 61 (see FIG. 3(*b*) upper portion). FIG. 3(*b*) illustrates the second connection structure 72 and its interaction with the second clamp 62. FIG. 3(*b*) also demonstrates the interaction of the first connection structure 71 and the second connection structure 72 with the bolt 64 as it is locked into the hole. The bolt 64 male screw portion is inserted into the hole, which is smaller in diameter than the head portion of the bolt 64. The female screw portion of the nut 65 is shown and the interior of nut 65 has a smaller diameter than the exterior of nut 65.

Next, the interaction between the first connection structure 71 and the second connection structure 72 is illustrated. Also shown in FIG. 3(*b*) is the securing bolt 64, the hole into which the bolt 64 is inserted and the nut 65 which secures the bolt 64 into the hole. Securing the bolt 64 to nut 65 also secures the first connection structure 71 and the second connection structure 72 together.

The components that are secured by bolt 64 and nut 65 are secured when the bolt 64 and the nut 65 are firmly screwed and tightened. The length of the bolt 64 matches that of the hole into which it is to be screwed. The bolt 64 and the nut 65 may be of a common length and diameter that makes replacing them easier, in case they are lost.

In FIG. 3(*b*), the first locking structure 75 is shown as attached to the arm pipe 17*a* and the first constriction structure 73 is shown as attached to the first connection structure 71. Also shown in this illustration, the second locking structure 76 is shown as attached to the arm pipe 17*a* and the second constriction structure 74 is shown as attached to the second connection structure 72.

In FIG. 3(*b*), the first locking structure 75 connects to the first side wall structure 73*a* and the first side wall structure 73*a* is attached to the rod 20*a* furthering the connectivity between arm pipe 17*a* and rod 20*a*. The second locking structure 76 connects to the second side wall structure 74*a* and the second side wall structure 74*a* is attached to the rod 20*a* furthering the connectivity. The first side wall structure 73*a* is used as a guide wall and stopping structure, in this configuration it can interact with the bushing 63 (see, FIG. 4(*b*) for further details). The second side wall structure 74*a* can also operate in a similar manner.

In one embodiment, the first connective structure 71 and the second connective structure 72 are attached to the rod 20*a*, with pressure being applied from both the first side wall structure 73*a* and the second side wall structure 74*a*. The reaction to the bolt 64 and the nut 65 being fully secured is that the first locking structure 75 as well as the second locking structure 76 are being separated. When the first locking structure 75 and the second locking structure 76 are put under pressure, arm pipe 17*a* acts as a fulcrum, and the connective structure 19*a* (see FIG. 3(*a*)) that is attached to the arm pipe 17*a* also becomes attached to the rod 20*a*.

To attach the arm pipe 19*a* and the rod 20*a* via the bolt 64 and the nut 65 only a single action (relative rotation of the bolt 64 and the nut 65) is used. The single action makes setting up the stand easier when assembling the electronic percussion stand system.

In order to attach the arm pipe 17*a* and rod 20*a* to the first clamp 61 and the second clamp 62, the only action required is the action of the bolt 64 and the nut 65. As a result, the electronic percussion instrument stand 10 can be easy to use and employ a minimal number of bolts to connect the pieces together, for example, by employing no more than one bolt and nut to attach the arm pipe 17*a* with the rod 20*a*.

To adjust the height along the first side wall structure 73*a* or along the second side wall structure 74*a* (these adjustments can be seen in the FIG. 4 (*d*) left and right hand sides concerning the first constriction structure 73 and the second constriction structure 74) a user can slide the component secured with the bushing 63 in or out of the constriction structures 73 and 74 to adjust it.

According to FIGS. 3(*b*) and 3(*c*) the exterior of the first locking structure 75 and the second locking structure 76 slide along the first protrusion structure 67 and the protrusion structure 66. The interior of the arm pipe 17*a* to the exterior of the same arm pipe 17*a* is shown with a 180 degree skew for clarity in FIG. 3(*c*). When these components are placed in such a position, the hole 65 is accessible. The vertical shaft of each hole 65 has a length d4 and is larger than the exterior width d3 of the first protrusion structure 67 and the second protrusion structure 66.

When the first protrusion 67 or the second protrusion structure 66 is inserted into the hole 65, the arm pipe 17*a* may be held in place with the first clamp 61 and the second clamp 62. The connective structure 19*a* can then be removed from the arm pipe structure 17*a* when the position of the hole 65 is shifted so that the first clamp 61 and the second clamp 62 are removed from the arm pipe 17*a*.

As shown in FIG. 3(*b*), when the first locking structure 75 and the second locking structures 76 are moved so that they face opposite directions, then the first surface component 79 and the second surface component 80 are moved to the exterior position so that the first surface component 79 and the second surface component 80 can be manipulated. As illustrated in FIG. 3(*b*), between the first surface component 79 and the second surface component 80 there is a space S, which can be used by the first locking structure 75 as well as the second locking structure 76 to move and alter locations.

As shown in FIG. 4(*c*), if the first surface component 79 and the second surface component 80 are moved closer to each other, the first protrusion structure 66 and the second protrusion structure 67 are released from the hole 65. Because the first protrusion structure 67 and the second protrusion structure 66 are released they are unable to stop the movement and allow the arm pipe 17*a* to change into a different position or be disassembled. With the release of the first clamp 61 and the second clamp 62 the arm pipe 17*a* can be detached.

With the above mentioned configuration this embodiment can release rod 20*a* from the first constriction structure 73 and the second constriction structure 74. Both constriction structures can be detached, and bushing 63 can also be removed from rod 20*a*. Thus the elasticity of the bushing 63 allows the first clamp 61 and the second clamp 62 to be moved and positioned accordingly.

The first side wall structure 73*a* can be adjusted by utilizing the adjustable connectivity between the first clamp 61 and the bushing 63. The flexible bushing 63 can control the movement of various components in order to change their positions within the over all formation (see FIG. 4(*b*)). The second side wall structure 74*a* can be controlled in the same manner as that described for first side wall structure 73*a*. Given the elasticity of the bushing 63, its movement can be regulated by the first clamp 61 and the second clamp 62.

The connective structure 19*a* shown in FIG. 3(*b*) can be in view when the connective structure 19*a* (see FIG. 3(*a*)) has been removed from the rod 20*a* and the bolt 64 and the nut 65 are loosened allowing the structure to be removed from arm pipe 17*a*. As the bushing 63 is slipped onto the rod 20*a* the flexible nature of the bushing 63 is utilized to change the position of the rod 20*a*. The diameter of the rod 20*a* is smaller than the internal diameter of the bushing 63. (see FIG. 17 internal flexible material cushion 63 with length d1, and the exterior of the rod 20*a* with a larger diameter d2) The bushing 63 has a smaller diameter d1 than the diameter d2 of the exterior of the rod 20*a* and provides a tight fit around the rod 20*a* to stabilize the entire assembly and to minimize vibrations and eliminating shaking. If the first clamp 61 and the second clamp 62 are moved into a position where first and second surface component 79 and 80 are in contact, then the first clamp 61 as well as the second clamp 62 move the first protrusion structure 67 and the second protrusion structure 66 into a position to be inserted back into the hole 65. In this position the first clamp 61 and the second clamp 62 can be safely lowered and removed from the arm pipe 17*a*.

FIGS. 4(*a*)-(*d*) illustrates the rod 20*a* attached to the first clamp 61 and the second clamp 62. FIG. 4(*a*) shows the first clamp 61 and the second clamp 62 in their relative positions with respect to the rod 20*a* and the mobility of the clamps in such a configuration.

FIG. 4(*b*) shows the first clamp 61 and the second clamp 62 as shown along the line IVb-IVb. In FIG. 4(*b*), arrow X is aligned with the axial direction of rod 20*a*, and arrow Y is aligned with the perpendicular direction to the axial direction of rod 20*a*.

FIG. 4(*c*) shows the first clamp 61 and the second clamp 62. This Figure illustrates the positioning of the first clamp 61 and the second clamp 62 in an open position for moving along rod 20*a*.

FIG. 4(*d*) shows the IVd-IVd line illustrations from FIG. 4(*c*) of first clamp 61 and second clamp 62. In FIG. 4(*c*), the arrow X is aligned with the axial direction of rod 20*a*, whereas arrow Y is aligned with the perpendicular direction to the axial direction of rod 20*a*.

In FIG. 4(*b*), the rod 20*a* is shown in an attached position with the first clamp 61. In FIG. 4(*b*) the interaction of the first side wall structure 73*a* and the first constriction structure 73 is shown. The first side wall structure 73*a* interacts with the bushing 63. The bushing 63 is configured to get contract more tightly around the rod 20*a*. As shown in FIG. 4(*a*), the first side wall structure 73*a* and its external structure 73*b* form a V shape when pressed by the rod 20*a* in two places.

FIG. 4(*b*) shows how the rod 20*a* is attached to the second clamp 62. This Figure shows the interaction of the second side wall structure 74*a* with the second constriction structure 74 and how the second side wall structure 74*a* interacts with the bushing 63. The flexible material cushion 63 contract around the rod 20*a* as discussed above. Also shown in FIG. 4(*a*), the second side wall structure 74*a* and its external structure 74*b* form a V shape when pressed by the rod 20*a* in two places. Also as the rod 20*a* gets compressed by the first side wall structure 73*a* and by the second side wall structure 74*a*, it becomes more closely coupled with the first clamp 61 and the second clamp 62.

In FIG. 4(*c*), the first clamp 61 and the second clamp 62 are shown to occupy the space S when they are not under pressure applied by bold 64 and nut 65. The first clamp 61 and the second clamp 62 are adjusted so that the first surface component 79 and the second surface component 80 come into contact. When these components are placed in a position of close proximity or contact these components are moved such that the first protrusion structure 67 and the second protrusion structure 66 are drawn out and away from the hole 65. In FIG. 4(*c*), the first protrusion structure 67 and the second protrusion structure 66 are withdrawn from the hole 65 and moved to a position from which it can be possible to detach or move the first clamp 61 and the second clamp 62 from the arm pipe 17*a*.

In FIG. 4(*c*), the first surface component 79 and the second surface component 80 are close to each other, while the first clamp 61, the second clamp 62, the first constriction component 73 and the second constriction component 74 are spaced apart. In that arrangement, first side wall component 73*a* and the second side wall component 74*a* are moved away from the rod 20*a* and thus, allow the release of rod 20*a*.

As shown in FIGS. 4(*c*) and 4(*d*), the rod 20 is released from the first clamp 61 and the second clamp 62 by moving the first and second surfaces 79 and 80 closer together. The outside diameter d6 of bushing 63 is larger than the diameter d5 of the circle C formed by the first external component 73*b* and the second external component 74*b*. Therefore, even if the first wall portion 73*a* and the second wall portion 74*a* are separated from rod 20*a*, the bushing 63 does not fall. This is possible because the first wall portion 73*a* and the second wall portion 74*a* are in contact with both sides of the shaft orientation (FIG. 4(*d*) X direction) of bushing 63.

As shown in FIGS. 4(*c*) and 4(*d*), movement of the first surface component 79 and the second surface component 80 results from movement of the first clamp 61 and the second clamp 62. Their movement could compress the first external component 73*b* and the second external component 74*b*, which could compress the tubular shape of the true diameter of first and second external structures d5 to a C shape. The compression would increase the size of the external diameter d6 of the bushing 63. Even though the first side wall component 73*a* and the second side wall component 74*a* have moved the same distance away from the rod 20*a*, the bushing 63 will move the position of the two side wall components 73*a* and 74*a* to compensate for the movement caused by the movement of first and second surfaces 79 and 80.

If the first side wall component 73*a* and the second side wall component 74*a* were to move away from the rod 20*a* then the bushing 63 would thwart excess movement along the first side wall component 73*a* and the second side wall component 74*a*. The bushing 63 would compensate by moving the rod 20*a* in conjunction with the first side wall component 73*a* and the second side wall component 74*a* in order to prevent excess movement. The rod 20*a* can also rely on the first clamp 61 and the second clamp 62 to retard any excess movement and to maintain overall unit cohesion.

Another embodiment of the current invention is shown in FIG. 5(*a*). FIG. 5 (*a*) is a view along the line IIIc-IIIc from FIG. 3(*a*). In FIG. 3(*c*) the first locking structure 75, the second locking structure 76, the first protrusion structure 67 and the second protrusion structure 66 are attached to the arm pipe 17*a* by the bolt 65. However, in the embodiment of FIG. 5(*a*), the first protrusion structure 67 and the second protrusion structure 66 and bolt 65 are coupled in a different manner as described in greater detail below.

In FIG. 5(*a*), the first locking structure 275 and the second locking structure 276, the first protrusion structure 67 and the second protrusion structure 66 are connected in the following arrangement. The external structure of the arm pipe 217*a* in this arrangement has not been changed and the arm pipe 217*a* maintains its tubular formation throughout. The first locking structure 275 and the second locking structure 276 are inside the arm pipe 217*a* and allow completely free movement and position change within the tubular shaped pipe structure. The first and second locking structures 275 and 276 engage the arm pipe 217*a* frictionally.

Because of this configuration the first clamp 261 and the second clamp 262 are allowed free movement and can change position within the tubular core of the arm pipe 217*a*. Moreover, the rod 20*a* has completely free movement and can change position within the tubular core of the arm pipe 217*a*.

Also because the hole 65 is not needed in this configuration the unit cost can be further minimized as can the cost for each arm pipe 217*a* component.

The embodiment of FIG. 5(*a*) does use the first protrusion structure 67 or the second protrusion structure 66 the amount of materials to be used in the construction of this device can be further minimized. Thus the cost of the arm pipe 217*a* and the manufacturing complexity of this device can be further minimized.

FIG. 5(*b*) illustrates another embodiment of the current invention. FIG. 5 (*b*) shows a view along the line IIIc-IIIc from FIG. 3(*a*). In the embodiment shown in FIG. 3(*c*)) arm pipe 17*a* had a hole 65 through it. Similarly, the embodiment in FIG. 5(*b*) has the tubular arm pipe 371*a* with a hole 365 through the arm pipe 371*a*.

The arm pipe 317*a* can be an extended and a wider version of arm pipe 17*a* and includes a hole 365. The hole 365 may be formed, such as drilled in a straight line through the tubular structure of the arm pipe 317*a*. The hole 365 creates a space allowing for at least 90 degrees of movement along the outer circumference of the arm pipe 317*a* in a straight line on opposing sides of the arm pipe 317*a*. The first protrusion structure 67 and the second protrusion structure 66 can be centered along the arm pipe 317*a* and from the center allow 90 degrees of movement. Since the protrusion structures 67 and 66 occupy 20 degrees of space along the arm pipe 317*a* circumference the total movement of the protrusion structures is 20 degrees less than total allowable rotation (90 degrees). Thus the first protrusion structure 67 and the second protrusion structure 66 can rotate along the arm pipe 317*a* circumference, up to at least a 70 degrees.

The hole 365 located at the outer circumference of the arm pipe 317*a*creates a central 90 degree angle from the center of the arm pipe 317*a*. The outside diameter of the first protrusion 67 and the second protrusion 66 occupies 20 degrees of the 90 degrees of the central angle. As a result, the first protrusion structure 67 and the second protrusion structure 66 are rotatable from 0 to up to 70 degrees within the arm pipe 317*a*.

The bolt 64 and the nut 65 (see FIG. 3(*b*)) can be loosen slightly to allow the free angular movement of first clamp 61 and second clamp 62. The arm pipe 317*a* could allow an angular movement as great as 120 degrees and the rod 20*a* would still be able to move freely and shift its position without threat to the stability or the strength of the stand. By allowing the movement in the first clamp 61 and second clamp 62 the rod 20*a* can also be rotated along a perpendicular direction to the arm pipe 317*a*.

This embodiment can also allow the arm pipe 317*a* to rotate along the axis of rotation to a maximum of 130 degrees without interfering with the hole 365 operation or disrupting the set up or play along the arm pipe 317*a*.

FIG. 6(*a*) is an illustration of another embodiment of the current invention. FIG. 6(*a*) is a view along line IIIc-IIIc from FIG. 3(*a*). An embodiment described above (see FIG. 3(*c*)) involved an initial shift of (180 degrees) in which the arm pipe 17*a* had a hole 65. In this embodiment of the current invention the tubular arm pipe 417*a* can have at least three sets of opposing holes 465 through the arm pipe 417*a*.

The arm pipe 417*a* can be a hollow tubular pipe and can have mutually opposing holes 465 drilled or otherwise formed through the pipe. The holes 465 are repeated at several places along the spine of the arm pipe 417*a* and are mutually opposing. Also in this embodiment the first protrusion structure 67 and the second protrusion structure 66 can be moved along the center core of the arm pipe 417*a*. The protrusions align along the line of the holes 465 in the arm pipe 417*a*, and the first locking structure 75 along with the second locking structure 76 are positioned along the interior of the arm pipe 417*a* at the various holes 465. This embodiment allows greater control and movement along arm pipe 417*a* and the selection of which holes 465 to utilize.

Because the hole 465, the first clamp 61 and the second clamp 62 are able to move about and change their position along the axis of the arm pipe 417*a*, it is also possible for the rod 20*a* to be moved to virtually any location alone the arm pipe 417*a* and be connected to the arm pipe 417*a* in any one of many different locations. In this embodiment the rod 20*a* is capable of attaching through the hole 465 in at least three different locations along the axis of the arm pipe 417*a*.

Also because there are more holes in this embodiment, the materials used for construction will be slightly reduced and thus, the overall cost will decrease per unit to produce the arm pipe 417*a*, similarly the engineering and construction issues may be decrease accordingly.

FIG. 6(*b*) illustrates another embodiment of the current invention. FIG. 6 (*b*) is a view along line IIIc-IIIc from FIG. 3(*a*). In the embodiment disclosed in FIG. 3(*c*) the first protrusion 67 and the second protrusion 66 are inserted into the arm pipe 17*a* at opposite ends on a parallel line. However in the embodiment in FIG. 6(*b*), the first incline structure 661 and the second incline structure 671 can replace the protrusions.

The first incline structure 661 and the second incline structure 671 are on the surface engaged with the first locking structure 575 and the second locking structure 576. The first incline structure 661 and the second incline structure 671 use the first protrusion structure 567 and the external second protrusion structure 566. The first protrusion structure 567 and the second protrusion structure 566 engage along the tubular surface of the arm pipe 17*a* (see FIG. 6(*b*)). Also the first locking structure 575 and the second locking structure 576 run along the surface of the tubular structure of the arm pipe 17*a* (see FIG. 6(*b*)). Arm pipe 17*a* allows the first protrusion structure 567 and the second protrusion structure 566 to run smoothly along the outside of the arm pipe 17*a*, but opposing the first incline structure 661 and the second incline structure 671 as the function of each is different. Thus the placement of each should not interfere with that of the other.

In order for the components to allow the rod 20*a* to connect to the arm pipe 17*a*, the bolt 64 and the nut 65 should be firmly attached and locked to secure the rod 20*a* to the arm pipe 17*a*. To prevent the removal of the first clamp 561 and the second clamp 562 the unit is secured. To remove the first clamp 561 and the second clamp 562 however, a user could first slide the first clamp 561 and next slide the second clamp 562 off of the tubular arm pipe 17*a* (see FIG. 6(*b*)) and then pull the first clamp 561 and the second clamp 562 off of the arm pipe 17*a*.

The hole 65 in one embodiment can be used to attach the first protrusion structure 67 and with the second protrusion structure 66, in order to secure the rod 20*a* into a position from which it might attach to the overall structure. In order to secure this formation the bolt 64 and the nut 65 may be firmly attached to the first clamp 61 and the second clamp 62 to the arm pipe 17*a* to insure stability and a secure hold (see FIGS. 4 (*a*) and 4(*c*)).

In another embodiment of the current invention, in order to move the first clamp 561 and the second clamp 562, the clamps are grasped by hand and pressure is applied to slide them along arm pipe 17*a* (see FIG. 6(*b*)). The hand movement may also be used to remove the clamps from the structure. In order to remove the first clamp 561 and the second clamp 562, the clamps are grasped by hand and pressure is applied to slide them off of the arm pipe 17*a*.

Figure 7:
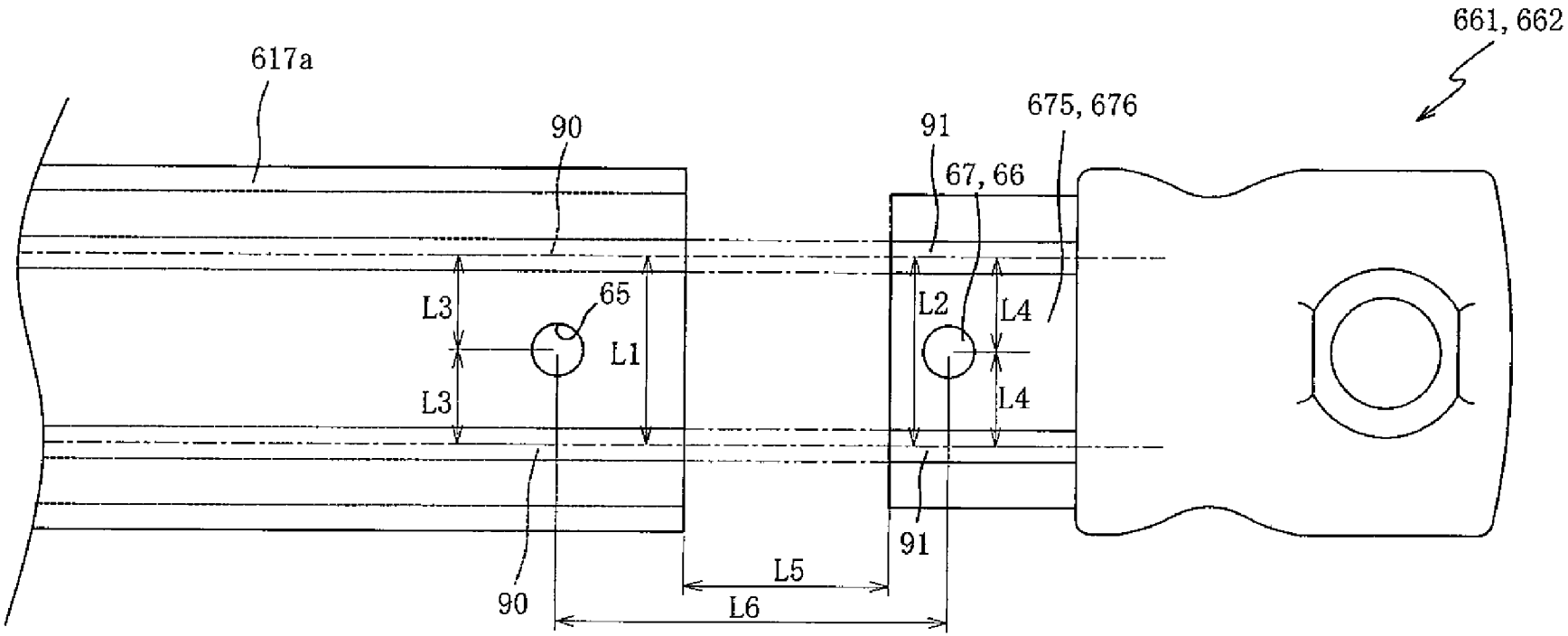
FIG. 7 is a sectional illustration of an arm pipe and a first locking structure and a second locking structure of another embodiment of the current invention as shown in FIG. 1.

FIG. 7 illustrates the first locking structure 675, the second locking structure 676 and the arm pipe 617*a* (see also, FIG. 3(*b*)). This embodiment shows the first locking structure 75 and the second locking structure 76 connected with arm pipe 17*a*. In this embodiment an internal view of the arm pipe 617*a* and a length wise illustration of the arm pipe 617*a* is shown. Also shown are, the pipe guide 90 along with the first locking structure 675, the second locking structure 676 as these locking structures are utilized to guide the guide receiver 91.

FIG. 7 illustrates the internal view of the arm pipe 617*a*, FIG. 7 shows the position of the pipe guide 90 in the arm pipe 617*a*. Also shown are the outer details of the first locking structure 675 and the second locking structure 676 and the guide receiver 91 and interaction of these component with the first protrusion structure 67 and the second protrusion structure 66. FIG. 7 shows a mechanism by which the first clamp 661 and the second clamp 662 rotate around on the pipe axis from side to side along preset grooves.

The pipe guide 90 can be formed in the interior of the arm pipe 617*a*. The guide receiver 91 can be part of the first locking structure 675 and the second locking structure 676. FIG. 7 illustrate the distance L1 between pipe guides 90 and the distance L2 between the guide receivers 91 units. The circumference and diameter of the pipe guide L1 (see FIG. 7) and the circumference and diameter of the guide receiver units L2 (see FIG. 7 top and bottom) are smaller than the receiver units. The pipe guide units 90 can be designed to fit within the groove of the guide receiver 91. This structure allows the first and second clamps to move back and forth within the arm pipe 17*a*. Thus the guide units 90 are inserted into the guide receiver 91 are slightly smaller to facilitate access. The above features allow the first clamp 661 and the second clamp 662 and their ability to move freely and reposition themselves along the axis of the arm pipe 617*a*.

The distance L3 is the distance between the middle of the pipe guide units 90 and the center of the hole in the pipe 65. Next, the distance L4 is the distance between the middle of the guide receiver 91 and the first protrusion structure and the second protrusion structure.

The pipe guide units 90 and the guide receiver 91 can function more efficiently and maintain their balance the first locking structure 675 and the second locking structure 676 can be held in balance within the arm pipe 617*a*. One of the entrance pipe guide units 90 (also the entrance section of the first locking structure 675 and the second locking structure 676 within the arm pipe 617*a*) can change its position based on the location of the above mentioned components and the relative position of the guide receiver 91. The first clamp 661 and the second clamp unit 662 are aligned with the first locking structure 675 and the second locking structure 676, to maintain equilibrium within the pipe structure the distance L5 is the position change. The distance L6 is the in length from the center of the first protrusion structure 667 and the second protrusion structure 666.

For one embodiment the first locking structure 675, the second locking structure 676, the pipe guide 90 and the guide receiver 91 can be aligned with each other. The hole 65 can accept the first protrusion structure 67 and the second protrusion structure 66. The first clamp unit 661 and the second clamp unit 662 are designed to move freely about the axis of the arm pipe 617*a* until they are properly secured.

The pipe guide units 90 are built to enter and connect with the guide receiver 91, from this connection the hole 65 is able to accept the first protrusion structure 67 and the second protrusion structure 66. This allows the first clamp unit 661 and the second clamp unit 662 to move freely along the axis of the arm pipe 617*a*.

In another embodiment of the current invention, after the hole 65 is connected with the first protrusion structure 67 and the second protrusion structure 66, other pieces of this unit are easy to assemble and lock into place.

In embodiments of the current invention, the ends of the pipe guide units 90 and the ends of the guide receiver 91 are easy to align, and it can be easy to find the distance L6 from the hole 65 to the first protrusion structure 67 and the second protrusion structure 66 and then once the pipe guide units 90 has been moved into alignment with the guide receiver 91, slight pressure may be applied to the two to form a seal. Then once these units are positioned and sealed, they should be locked by pressing and sealing the first clamp 661 and then the second clamp 662. Doing this will also lock in the first protrusion structure 67 and the second protrusion structure 66 into their position within the hole 65. Once that is finished, the rod 20*a* can be attached to the arm pipe 617*a* (see also, FIG. 3(*a*)).

Figure 8:
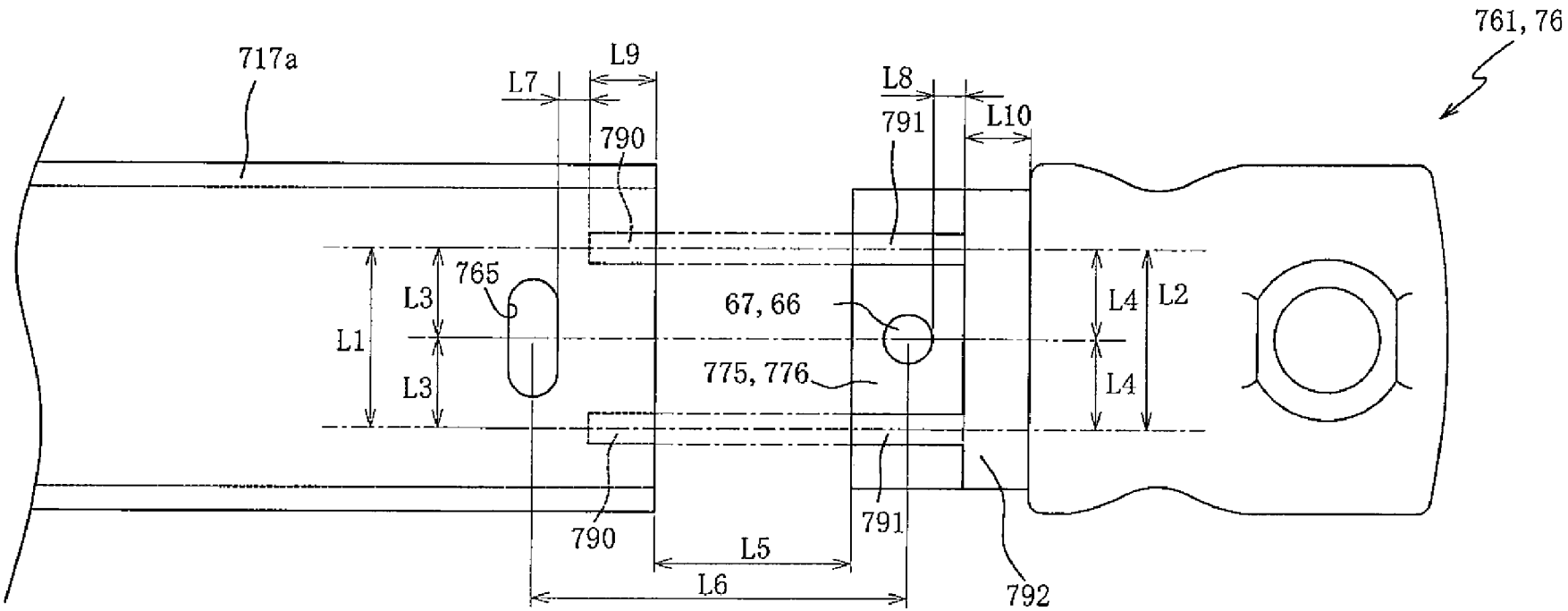
FIG. 8 is a sectional illustration of an arm pipe and a first locking structure and a second locking structure of another embodiment of the current invention as shown in FIG. 1.
Figure 9:
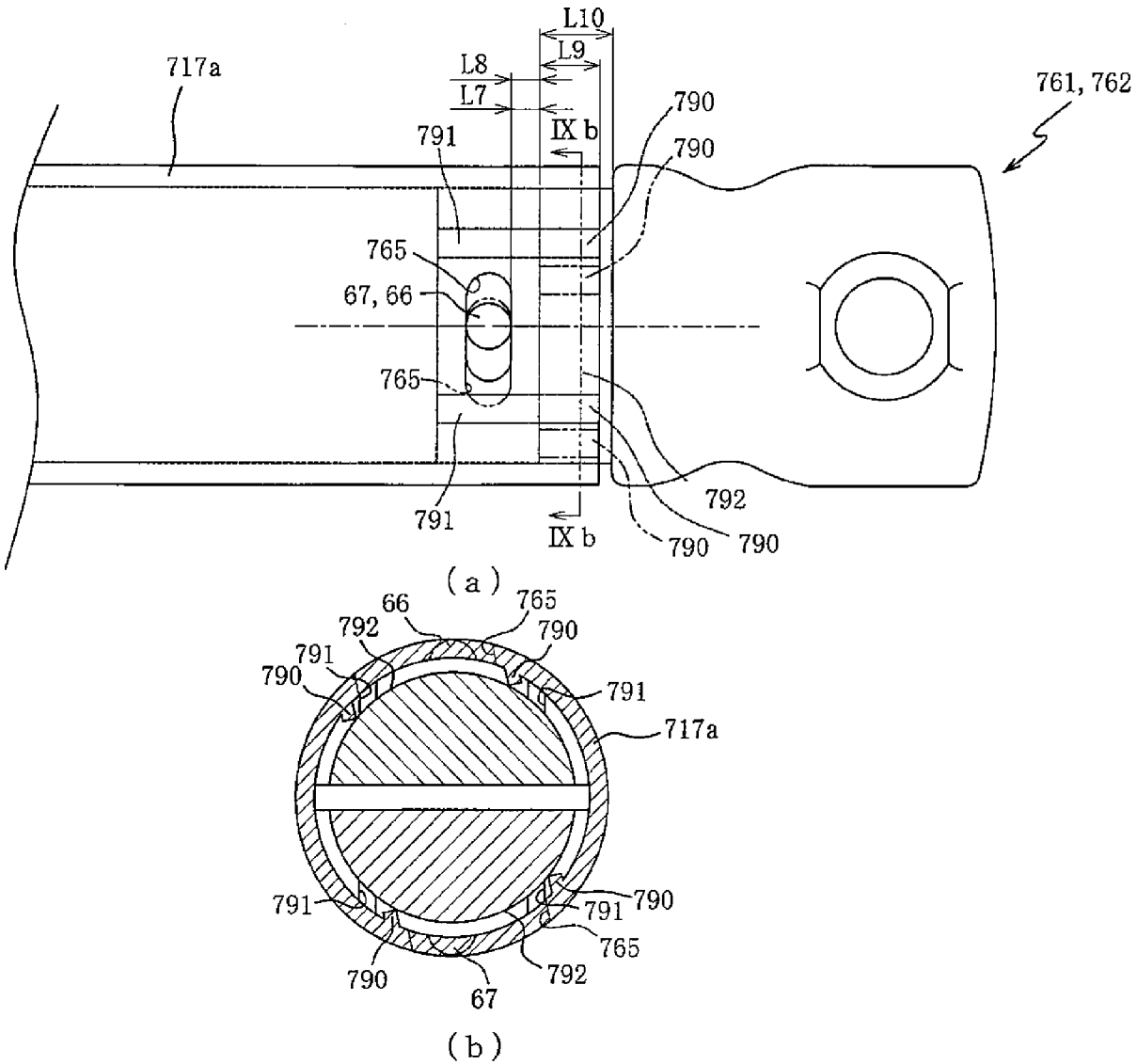
FIG. 9(*a*) is a sectional illustration of an arm pipe and a first locking structure and a second locking structure according to another embodiment of the current invention as shown in FIG. 1.

FIGS. 8 and 9, both illustrate another embodiment of the current invention. FIG. 8 shows the sectional display of the intersection of the arm pipe 717*a* and the first locking structure 775 and the second locking structure 776. FIG. 9(*a*) shows the sections of this embodiment, which deal with the arm pipe 717*a* and the first locking structure 775 and the second locking structure 776. FIG. 9(*b*) shows the arm pipe 717*a* as viewed along the line IXb-IXb perspective of the FIG. 9(*a*). FIG. 9(*a*) illustrates the arm pipe 717*a* and the first locking structure 775 and the second locking structure 776. The illustration of the connection between the arm pipe 717*a* with the first locking structure 775 and the second locking structure 776 shows both halves of the inner circumference of the arm pipe 717*a*.

As another embodiment of the current invention (see also, FIG. 3(*b*)) the arm pipe 17*a* is inlayed with the first locking structure 75 and the second locking structure 76, the first locking structure 775 and the second locking structure 776 are connected to the pipe guide unit 790 and the guide receiver 791. The moveable guide receiver unit 792 is set up such that the first locking structure 775 and the second locking structure 776 is able to move in a controlled manner within the pipe arm 717*a*.

In FIG. 8, the interior of the pipe arm 717*a* is illustrated, and the pipe guide 790 and the hole 765 in the arm pipe 717*a* (see FIG. 8). This illustration also shows the exterior of the first locking structure 775 and the second locking structure 776. Also shown is the interaction of the first locking structure 775, the second locking structure 776 and the guide receiver 791 and how these fit the groove guided first clamp 761 and the second clamp 762.

The pipe guide unit 790 and the guide receiver 791 and their interaction with the arm pipe 717*a*, the first locking structure 775 and the second locking structure 776 and the pressure that is applied to each depends on the position illustrated in FIG. 8. The distance L1 is the distance between the two pipe guide 790 with the distance L2 being the distance between the two guide receiver unit 791.

The diameter of the pipe guide unit 790 (FIG. 8 top and bottom) is less than the diameter of the guide receiver 791 (FIG. 8 top and bottom). Because the guide receiver 791 has a smaller diameter than the pipe guide unit 790, the movement of the pipe guide 790 can be controlled by the guide receiver 791, and they both can be laminated within the other for added stability and control.

The distance L3 is the difference in length between the center of the pipe guide unit 790 and the hole 765 and the distance L4 is difference between the length distance of the guide receiver 791 and the first locking structure 775 and the second locking structure 776.

FIG. 8 shows the first locking structure 772 and the second locking structure 776 that opposes the arm pipe 717*a*. The pipe guide unit 790 and the guide receiver 791 are parallel to each other and are capable of engaging each other. The arm pipe 717*a* has a opening in which the first locking structure 775 and the second locking structure 776 are interested. Distance L5 is the distance from the opening of pipe guide unit 790 to the head of the guide receiver 791. Distance L6 is the distance from the hole 765 to the first clamp 67 and the second clamp 66. The distance L6 can be longer than distance L5.

In FIG. 9(*a*), the pipe guide unit 790 is connected the guide receiver 791 by pressure from the first clamp 761 and the second clamp 762. The protrusions 67 and 66 can be forced into the hole 765 and go through the center of the hole 765.

FIG. 8 shows the shape and how far the pipe guide 790 can enter into the entrance of the arm pipe 717*a*, where this distance is shown as L9. The hole 765 in the arm pipe 717*a* is drilled straight through. The entrance diameter and position of the hole 765 relative to the exterior is directly related to the ability of the pipe guide unit 790 to move in the arm pipe 717*a* (see FIG. 9) and the position relative to the length differential is shown as L7.

The guide receiver 791 are in direct proportion to the length of the first clamp 761 and the second clamp 762 (see FIG. 9). As the guide receiver 791 moves, the guide receiver 791 can connect with the other guide receiver 792. The guide receiver unit 792 moves and joins with the pipe guide 790 inside the arm pipe 717*a*. The guide receiver unit 792 has similar characteristics as the guide receiver 791, except it is moveable.

As shown in FIG. 8, the protrusion structures 66 and 67 move in the inside of the hole 765 and the arm pipes 717*a*. The pipe guide 790 reaches the guide receiver 792 via the guide receiver 791. The pipe guide 790 reaches the guide receiver 792 via guide receiver 791. As a result, the angle of the first clamp 761 and the second clamp 762 can be adjusted. Distance L7 and distance L8 can be of approximately the same length. The pipe guide 790 moves linearly in the guide receiver 791 in the guide receiver 791, when the first clamp 761 and second clamp 762 are inserted into the arm pipe 717*a*. The protrusion structures 66 and 67 reach the hole 765 when the first and second claims 761 and 762 are inserted into the arm pipe 717*a*.

In FIG. 9(*a*), the depth of the moving guide receiver unit 792 shown as L10 and the length of the pipe guide shown as L9 is consistently larger. As shown in the two line drawings as seen in FIG. 9(*a*) the moving guide receiver unit 792 can completely receive the line guide 790.

The pipe guide unit 790 can connect with the guide receiver 791 and as the first clamp 761 and the second clamp 762 exert pressure upon the arm pipe 717*a*, the pipe guide unit 790 seals tighter against the guide receiver 791 as the protrusion structures 66 and 67 are pressed and connected more firmly into the hole 765. As the protrusion structures are pressed ever more firmly into the hole 765, the pipe guide unit 790 moves into the moving guide receiver unit 792.

In this instance, as shown in FIG. 9(*b*), the protrusion structure 66 and 67 and the pipe guide 90 can move within the arm pipe 717*a*. However, while the first clamp 61 and the second clamp 62 can move within arm pipe 717*a* the protrusion structure 66 and 67 will remain fixed within the hole 765.

For example, even if the first protrusion structure 67 and the second protrusion structure 66 are fixed into the hole 65, the positioning of the piping structure and the position of the individual components can be done by the person who is setting up the unit to ensure proper alignment. The precise positioning of various components is not automatic with setup and can be aligned according to the artist's preference.

The length of the movement between the first protrusion structure 67, the second protrusion structure 66, the guide receiver 791 and the mobile guide receiver 792, whose length is shown as L8, is designed to be greater than that of the distance between the hole 765 and the pipe guide unit 790, shown as L7. When the first protrusion structure 67 and the second protrusion structure 66 is connected to the hole 765, the pipe guide unit 790 becomes connected to the mobile guide receiver unit 792 instead of the guide receiver 791.

Also, the length of the pipe guide unit 790, is shown as L9, can be inserted, into the depth of the mobile guide receiver unit 792 measured as L10, the mobile guide receiver 792 can expand to fit the inserted pipe guide unit 790 and is able to move, once inserted into the arm pipe 717*a*. However, even when the first clamp 67 and the second clamp 66 are tightened to exert pressure upon the arm pipe 717*a*, the positioning of the first clamp 767 and the second clamp 766 can be altered along the exterior of the arm pipe 717*a*.

Also the first clamp 767 and the second clamp 766 can exert pressure along the arm pipe 717*a* and restrict the movement of the pipe guide unit 790 upon receiving the guide receiver 791. The connecting position along the arm pipe 717*a* of the first clamp 767 and the second clamp 766 can be altered.

Once the installer has fastened and tightened the first clamp 767 and the second clamp 766, they are capable of movement along the arm pipe 717*a*. When the first clamp 767 and the second clamp 766 are fastened down, they exert pressure upon the arm pipe 717*a*, but the first clamp 767 and the second clamp 766 will still be slightly moveable. To limit this mobility, the installer may attach the rod 20*a* (see FIG. 3(*a*)) to the structure for increased stability and strength.

Figure 10:
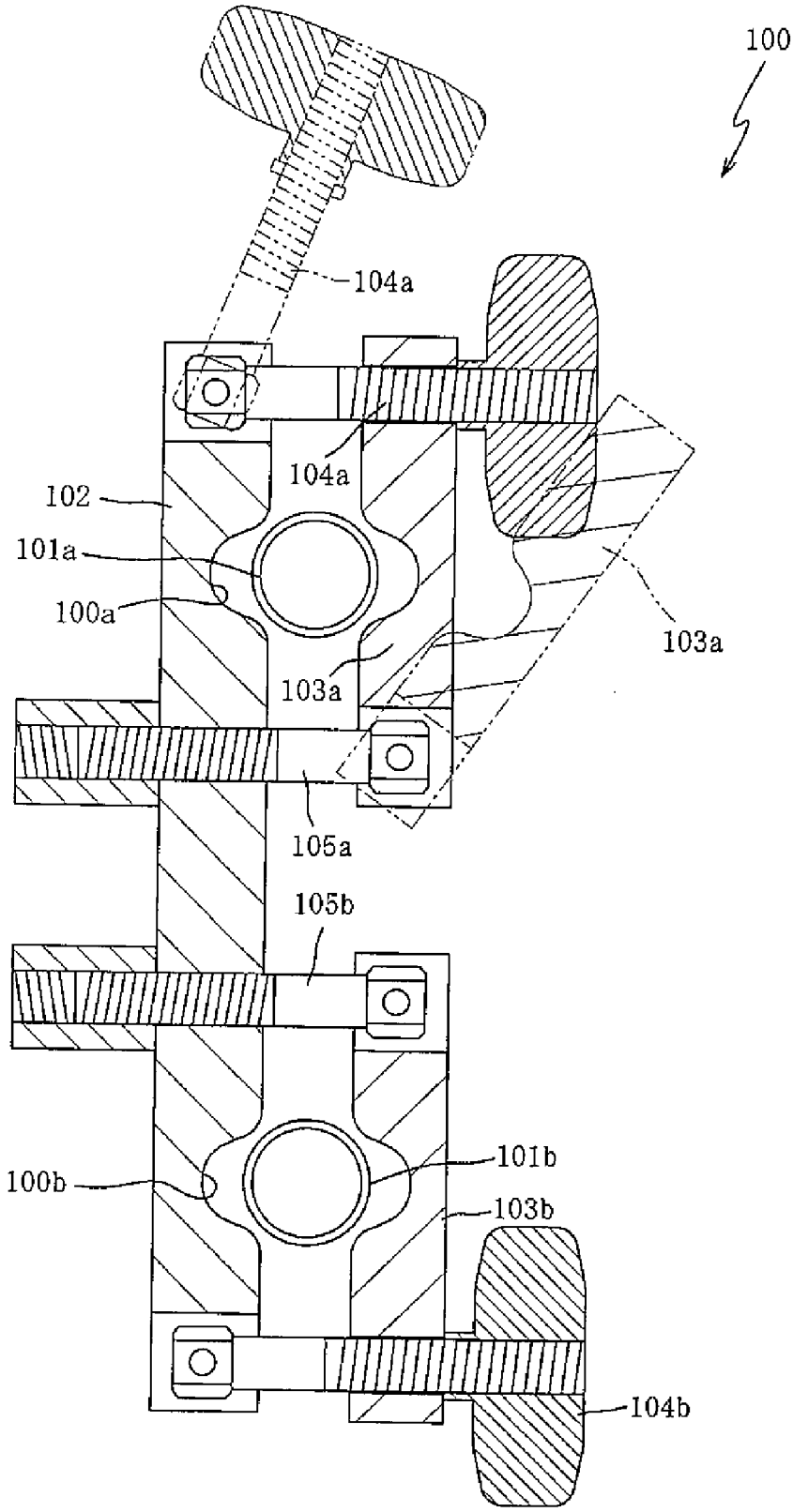
FIG. 10 is an illustration of a clamp structure currently utilized for electronic percussion instrument stand.

FIG. 10 is an illustration of the clamping units described as clamp unit 100. As shown in FIG. 10 the clamp unit 100 is attached to the first pipe 101*a* and second pipe 101*b*, via the first constriction section 100*a* and second constricting structure 100*b*. The constriction structures use clamp unit 102, the first pressure unit 103*a* and the second pressure unit 103*b*. The first pressure unit 103*a* and the second pressure unit 103*b* can be attached to the clamping unit 102 by bolts 104*a*-105*b*.

The clamp unit 100 allows the first pipe unit 101*a* and the second pipe unit 101*b* to extend and rotate and allows the altering of the basic position of the various components attached thereto. Therefore the relative positioning of the two pipes, pipe 1 and pipe 2, as well as the armatures attached thereto can be changed freely, the height, the pitch, the space, and the relative position can all be changed to suit the artist utilizing the stand.

A detailed explanation and illustration of the embodiments of the current invention is described herein. However, the invention is by no means limited to those few configurations. Embodiments of the present invention, can be extremely variable and capable of any number of configurations aside from those few listed above.

For example, there are many possible variations (such as; angle, pitch, length, positioning and configuration) due to the variable nature of the design and the flexibility of the components and their possible interactions and positioning.

In the above explanation of the first embodiment of this design it was shown how the bushing 63 was placed within the structure. However, the bushing 63 can be moved and the material repositioned to provide site and component specific padding for even greater flexibility. The bushing 63 can be replaced within the structure altogether and the structure can be reconfigured to be a completely different structure and thus create different sound performance. In this case the size of the bushing 63 in the unit may be minimal and therefore the construction procedures may be simplified and the bushing 63 material cost may decrease per unit.

In the one embodiment of this invention, it was shown that due to the thickness and depth of the bushing 63, the movement along the first side wall structure 73*a* and the second side wall structure 74*a* was controlled. However, it is possible to regulate movement along the first side wall structure 73*a* and the second side wall structure 74*a* via other means. Accordingly, if the thickness of the bushing 63 were reduced, it would be possible to control movements along the first side wall structure 73*a* and the second side wall structure 74*a* by adjusting the rod 20*a*. If the rod 20*a* were to be attached in such a way that the pressure exerted upon the main piping was increased, then the size of the bushing 63 could be reduced without undue effect on the control of movement of the first side wall structure 73*a*and the second side wall structure 74*a*.

It is possible to fill the space which would be left open by the removal of a significant portion of the bushing 63. With the removal of a large part of the bushing 63, the resulting loss of elasticity of the unit could be made up for within the piping structure itself with the rod 20*a* acting as reinforcement for the first side wall structure 73*a* and the second side wall structure 74*a*.

In above embodiments, pushing process of the arm pipe 17*a* was described. However, it is acceptable for the arm pipe 17*a* to act as a pull based system rather than a pushing based system. In this case, the arm pipe 17*a*, an aluminum pipe system, can take less strain and pressure within the hollow core during play. The amount of heat energy and effort required to adjust the system could also conceivably be lessened. In addition, the per unit production costs for the arm pipe 17*a* may be reduced and thus the cost for replacement and or repair may also be reduced.

What is claimed is:

1. A stand for electronic musical instruments comprising:

a first tubular pipe coupled to a second pipe using a connection member;

the connection member further comprising: a first clamp and a second clamp that clasp the second pipe; a bolt member to fasten the first clamp and the second clamp;

the first clamp further comprising: a first insertion section inserted into the inner circumference of the first tubular pipe; one end of the first section capable of being coupled to the bolt member the other end having a first hold section;

the second clamp further comprising: a second insertions section inserted into the inner circumference of the first tubular pipe; one end of the second section capable of being coupled to the bolt member the other end having a first hold section; and the first section and the second section insertable into the first tubular pipe by using the second pipe as a fulcrum and spreading the inserted ends of the clamp members against the first tubular pipe.

2. The stand for electronic musical instruments as recited in claim 1, the first section further comprising at least one protrusion that can be inserted into at least one hole from the outside of the first tubular pipe to the inner surface of the first tubular pipe; the second section first section further comprising at least one protrusion that can be inserted at least one hole from the outside of the first tubular pipe to the inner surface of the first tubular pipe;

wherein the hole has a larger bore than the outside diameter of the protrusion.

3. The stand for electronic musical instruments as recited in claim 1, wherein when the at least one protrusion is inserted in the hole, the protrusion moves in a path away from the center of the first tubular pipe;

wherein the insertion of the at least one protrusion allows the position of first and second clamps to be adjusted within the first tubular pipe.

4. The stand for electronic musical instruments as recited in claim 1, the first tubular pipe further comprising a guide that travels along the inner surface of the first tubular pipe; the first insertion section and the second insertion section further comprising a guide receptacle capable of engaging with the guide in the first tubular pipe; wherein when the guide receptacle and guide engage the at least one protrusion in the first insertion section and the at least one protrusion in the second section can be guided towards the at least one hole in the first tubular pipe.

5. The stand for electronic musical instruments as recited in claim 1, the connection member further comprising a bushing made of elastic material; the bushing is located between the first hold section and the second hold section; the bushing is capable of elastic deformation causing a frictional force between the first hold section, the second hold section and the second pipe; the frictional force is capable of immobilizing the second pipe within connection member.

6. The stand for electronic musical instruments as recited in claim 1, the bushing further comprising an elongated ring with a bore smaller than the outside diameter of the second pipe; the second pipe capable of being inserted into the bore of the bushing wherein the bushing exerts elastic force upon the pipe; the first hold section further comprising a first wall portion facing the second pipe and clasps portions of the outer circumference of the bushing; the second hold section further comprising a second wall portion facing the second pipe and clasps portions of the outer circumference of the bushing; wherein the second pipe is coupled to the first wall portion and the second wall portion via the bushing.

7. The stand for electronic musical instruments as recited in claim 6, wherein the first and second section are coupled using the bolt, and the height of the first wall portion and the second wall portion is smaller than the thickness from the inner surface the bushing to the external surface of the bushing; the second pipe is held in place by the force applied by the first and second wall portions onto the bushing that surrounds the second pipe.

8. The stand for electronic musical instruments as recited in claim 5, the first and second clamps further comprising accommodation section formed by the opposing surfaces of the first and second clamps; the accommodation section accommodates the bushing when the first section and the second section are coupled using the bolt.

9. An apparatus for supporting one or more musical instruments, the apparatus comprising:

a support rod;

a bushing on the support rod;

at least one arm;

at least two clamp members, each clamp member having an inner end and an outer end; the inner end of each clamp member is configured to be coupled to the at least one arm;

wherein the bushing on the support rod is arranged between the two clamp members and the two clamp members are configured to be moved together at their outer ends to clasp the bushing around the rod and to spread the inner ends of the clamp members outward to couple the clamp members to the at least one arm.

10. The apparatus as recited in claim 9, wherein the at least one arm comprises a tubular member having an open end for receiving the inner end of each clamp member, the tubular member further comprising at least one hole and the at least two clamp members each comprise at least one protrusion that can be inserted into the at least one hole in the arm, when the inner end of each clamp member is received within the open end of the tubular member.

11. The apparatus as recited in claim 10, wherein the protrusion has at least one inclined surface.

12. The apparatus as recited in claim 10, wherein the at least one hole has a width dimension sufficient to allow movement of the protrusion within the hole to allow rotational movement of the clamp members within the tubular member.

13. The apparatus as recited in claim 9, wherein the arm comprises a tubular member having an open end for receiving the inner end of each clamp member.

14. The apparatus as recited in claim 9, the arm further comprising at least one pipe guide running the length of the interior of the arm for guiding a guide receiver that is part of the at least two clamp members into the interior of the arm.

15. The apparatus as recited in claim 9, wherein the bushing comprises a flexible material placed around the rod and having an interior diameter smaller than an exterior diameter of the rod.

16. The apparatus as recited in claim 9, wherein the at least one arm comprises a plurality of holes for the insertion of at least one protrusion of the at least two clamps.

17. The apparatus as recited in claim 9, wherein the inner end of each clamp member presses against the interior surface of the at least one arm, when the outer end of the clamp members are moved together.

18. The apparatus as recited in claim 9, further comprising a single unit bolt with threads that allow tightening without a nut that moves the outer ends of each clamp member together to tighten each clamp member around the bushing to spread the inner ends of the clamp members apart.

19. The apparatus as recited in claim 18, wherein the at least one arm comprises a tubular member having an open end for receiving the inner end of each clamp member, the tubular member further comprising at least one hole and the at least two clamp members each comprise at least one protrusion that can be inserted into the at least one hole in the arm, when the inner end of each clamp member is received within the open end of the tubular member;

wherein tightening the single nut causes the at least one projection of each clamp member to be inserted into the at least one hole in the arm.

20. The apparatus as recited in claim 18, wherein tightening the single bolt unit causes the inner ends of the clamp members to press against the inner surface of the arm.

21. The apparatus as recited in claim 9, each clamp member further comprising a concave shape opposing the other clamp member, creating sufficient space for the rod and the bushing surrounding the rod;

each clamp member further comprising at least one protrusion to be inserted into at least one hole in the arm; the protrusions located closer to the inner end of the clamp;

each clamp further comprising a space that allows a bolt and nut to secure the outer ends of each clamp member together.

* * * * *